US006158229A

United States Patent [19]

Aizawa

[11] Patent Number: 6,158,229

[45] Date of Patent: Dec. 12, 2000

[54] HEAT EXCHANGER, METHOD OF REUSING AND RECOVERING REFRIGERANT THEREOF

[76] Inventor: Nikichi Aizawa, 1-11, Minamirinkan 4-chome, Yamato-shi, Kanagawa-ken, Japan

[21] Appl. No.: 09/360,152

[22] Filed: Jul. 26, 1999

Related U.S. Application Data

[63] Continuation of application No. 08/868,721, Jun. 4, 1997, abandoned.

[30] Foreign Application Priority Data

| | | | |
|---|---|---|---|
| Jun. 4, 1996 | [JP] | Japan | 8-141690 |
| Jul. 30, 1996 | [JP] | Japan | 8-199486 |
| Jan. 8, 1997 | [JP] | Japan | 9-1599 |

[51] Int. Cl.[7] ..... F25B 45/00

[52] U.S. Cl. ..... 62/77; 62/299; 62/298

[58] Field of Search ..... 62/298, 299, 77

[56] References Cited

U.S. PATENT DOCUMENTS

| | | | |
|---|---|---|---|
| 3,578,073 | 5/1971 | Bosquain | 165/111 |
| 3,611,743 | 10/1971 | Manganaro . | |
| 4,285,206 | 8/1981 | Koser . | |
| 5,191,770 | 3/1993 | Kim . | |
| 5,297,395 | 12/1995 | Ozu et al. | 62/174 |
| 5,471,848 | 12/1995 | Major et al. | 62/149 |
| 5,479,788 | 1/1996 | Roegner | 62/292 |

FOREIGN PATENT DOCUMENTS

| | | |
|---|---|---|
| 0 568 264 | 11/1993 | European Pat. Off. . |
| 40 26 868 | 3/1991 | Germany . |
| 56-58067 | 10/1954 | Japan . |
| 63-46347 | 9/1963 | Japan . |
| 63-19124 | 2/1988 | Japan . |
| 5-133633 | 5/1993 | Japan . |

OTHER PUBLICATIONS (1) A. Althouse et al., "Modern Refrigeration and Air Conditioning", 1988.

*Primary Examiner*—Denise L. Ferensic
*Assistant Examiner*—Mark Shulman
*Attorney, Agent, or Firm*—Lowe Hauptman Gopstein Gilman & Berner, LLP

[57] ABSTRACT

In order to seal in refrigerant in a heat exchanger as much quantity as possible till to reuse the refrigerant at a new place of the heat exchanger after transfer or till to recover the refrigerant at a refrigerant recovery site, even when electricity is suspended to the new place or when outside temperature is lower than a certain temperature at the place where the heat exchanger such as an air conditioner having a separated interior instrument and exterior instrument is being installed, two on-off valves are provided in the refrigerant piping of the interior instrument besides two on-off valves provided in the refrigerant piping of the exterior instrument, or on-off valves are provided in each connecting pipe connecting with the refrigerant piping of the interior instrument and the refrigerant piping of the exterior piping, and the refrigerant is sealed in by closing all the on-off valves.

8 Claims, 24 Drawing Sheets

HEAT EXCHANGER, METHOD OF REUSING AND RECOVERING REFRIGERANT THEREOF

This application is a Continuation of application Ser. No. 08/868,721 filed Jun. 4, 1997.

BACKGROUND OF THE INVENTION

1. Field of the Invention

The present invention relates to a heat exchanger having an interior instrument and an exterior instrument, methods for reuse of refrigerant and methods for recovery of the refrigerant used in the heat exchanger, the heat exchange being applicable to various air conditioners used in structures such as building, trains, cars, ships, and airplanes, as well as freezers and refrigerators (including use for vehicles such as ships ) for foods such as fish, vegetables and meats.

2. Description of the Related Art

An air conditioner utilizing heat exchangers generally consists of a separate interior instrument and an exterior instrument. When the separate type air conditioner is used for building structures, the interior instrument is placed inside the house and the exterior instrument is located outside the house. First refrigerant piping which is provided with an interior heat exchanger is joined with the interior instrument and second refrigerant piping which is provided with an exterior heat exchanger is joined with the exterior instrument. The first refrigerant piping and the second refrigerant piping are joined to each other by means of two connecting pipes forming a refrigerant circulating channel along which the refrigerant circulates in the whole air conditioner.

The second refrigerant piping is separately provided with two on-off valves on upper reaches and lower reaches of the refrigerant flow through the exterior heat exchanger. When a leased or rented air conditioner is transferred from an original point of use to a new location on expiration of the contract, or a superannuated air conditioner is carried to a disposal, without release of refrigerant such as chlorofluorocarbons into the atmosphere, the following steps are usually carried out. The air conditioner being set to cooling mode, among the two on-off valves one on-off valve (on-off valve for higher pressure) is closed and the other on-off valve (on-off valve for lower pressure) is opened, and a compressor motor which is arranged between the two on-off valves in the second refrigerant piping is started. Through the steps described above, the refrigerant in the first refrigerant piping and the refrigerant in the connecting pipes are sucked into the second refrigerant piping, and all the refrigerant is sealed in the second refrigerant piping by closing the opened on-off valve. Then the motor is stopped. (these steps are called a pump down).

Pump down cannot occur when the power supply to a building in which the air conditioner is installed is suspended, because the pump down can only be conducted when the compressor motor is on. Thus the electricity supply is a necessary condition for the pump down. And as the pump down is carried out in cooling mode in a reversible air conditioner, it needs a higher environmental temperature than is usual for such an air conditioner which is designed not to be pumped down at below a certain environmental temperature to avoid compressor motor overload.

The purpose of the present invention is to seal in refrigerant used in a heat exchanger such as an air conditioner in as much quantity as possible even when electricity supply is suspended, or even when the outside temperature is below a certain temperature, and to reuse the sealed-in refrigerant at a new place when the heat exchanger is transferred from an original place to the new place, and further to recover the sealed-in refrigerant when the heat exchanger is disposed of.

SUMMARY OF THE INVENTION

The present invention relates to a heat exchanger which has a separated interior instrument and exterior instrument, a first refrigerant piping arranged in the interior instrument, and provided with an interior heat exchanger, a second refrigerant piping arranged in the exterior instrument and provided with an exterior heat exchanger, two connecting pipes forming a refrigerant circulating channel to circulate a refrigerant circulates by being connected with the first refrigerant piping and the second refrigerant piping, and two on-off valves separately arranged on upper and lower reaches of the second refrigerant piping in which the refrigerant flows through the exterior heat exchanger. Two on-off valves are separately arranged on upper and lower reaches of the first refrigerant piping in which the refrigerant flows through the interior heat exchanger.

In a heat exchanger according to the present invention, when electricity is suspended, or outside temperature is below a certain temperature, the refrigerant in the first refrigerant piping between the two on-off valves and the refrigerant in the second refrigerant piping between the two on-off valves can be sealed in by closing all the on-off valves respectively.

The on-off valves may be provided at the end portions of the first refrigerant piping and the second refrigerant piping to where connecting pipes are joined or may be positioned apart from the end portions.

When the heat exchanger is transferred because of a lease contract or a rent contract, methods to reuse the refrigerant according to the present invention includes the steps of closing all the four on-off valves before transfer of the heat exchanger, removing the connecting pipes from the first refrigerant piping and the second refrigerant piping, reconnecting the connecting pipes to the first refrigerant piping and the second refrigerant piping after the transfer of the heat exchanger, and then supplying the shortage of the refrigerant into the refrigerant circulating channel with opening the four valves.

Through the steps above described, the refrigerant sealed in the first refrigerant piping and the second refrigerant piping before the transfer of the heat exchanger can be reused after the transfer of the heat exchanger so that the amount of supply corresponding to the shortage of the refrigerant can be minimized.

Supplying the shortage of the refrigerant in the refrigerant circulating channel may be carried out by providing a connecting point to which the refrigerant supply instrument is connected at the first refrigerant piping, the second refrigerant piping or the connecting pipes. But it is preferable to replace at least either two of the two on-off valves in the first refrigerant piping or the two on-off valves in the second refrigerant piping with three-port valves having a port to be connected with the refrigerant supply instrument so that the supply of the shortage of the refrigerant into the refrigerant circulating channel can be carried out by connecting the port with the refrigerant supply instrument.

The steps described above makes it unnecessary to prepare any connecting point for connection with the refrigerant supply instrument at the first and the second refrigerant piping or the connecting pipes, therefore the refrigerant flow circuit of the heat exchanger can be simplified.

The recovery methods of the refrigerant according to the present invention when the heat exchanger is disposed of because of wear and tear, include closing of the four on-off valves before disposal of the heat exchanger, removing the connecting pipes from the first refrigerant piping and the second refrigerant piping, carrying the heat exchanger to a refrigerant recovery site, then recovering the refrigerant in the first refrigerant piping and the second refrigerant piping and disposing of the heat exchanger.

Accordingly, the refrigerant sealed in the first refrigerant piping and the second refrigerant piping can be recovered.

Recovering of the refrigerant in the first refrigerant piping and the second refrigerant piping at a refrigerant recovery site, may be carried out by providing connecting points to be connected with the refrigerant recovery instrument at the first refrigerant piping and the second refrigerant piping. But it is preferable to replace at least one on-off valve in the first refrigerant piping and in the second refrigerant piping with a three-port valve having a port to be connected with the refrigerant recovery instrument.

Thus, the connecting points to be connected with the refrigerant recovery instrument at the first refrigerant piping and at the second refrigerant piping are not required, the refrigerant flow circuit of the heat exchanger can be simplified.

The two on-off valves provided in the first refrigerant piping according to the present invention, may be individually attached to the interior instrument, but it is preferable to preliminary integrate the two on-off valves into a unit before mounting to the interior instrument.

Thus, integrating the two on-off valves into a unit helps to simplify the mounting to the interior instrument, and smooth handling in the case of maintenance. The integrating can be applied to the two on-off valves in the second refrigerant piping.

Incidentally, the integration of the two on-off valves into a unit includes connecting the two on-off valves with a connecting member which makes the two on-off valves into one unit. The unit is easily made from cast iron. When a connecting member is used for the connecting, the connecting member may be used as a mount for securing the two on-off valves to the interior instrument.

In such a case that the length of the first refrigerant piping is too short to reach the position of at least one on-off valve to be provided in the first refrigerant piping, it is preferable that the first refrigerant piping is formed with a main pipe and an auxiliary refrigerant pipe extending from an end portion of the main pipe to the above described on-off valve which is p preferably connected to the auxiliary pipe before installing to the interior instrument.

Through the steps above described, the one on-off valve and the auxiliary refrigerant pipe are smoothly connected to the interior instrument.

In a standard heat exchanger which is not provided with two on-off valves in the first refrigerant piping, an end portion of a first refrigerant piping and an end portion of a connecting pipe near the first refrigerant piping are connected by means of a male screw or a female screw in male-and-female connection.

In a case that the end portions of the first refrigerant piping and the end portions of the connecting pipe on the side of the first refrigerant piping are in male-and-female relations coupleable with each other, two on-off valves in the first refrigerant piping are arranged at the connecting points of the first refrigerant piping with the two connecting pipes, end portions of the two on-off valves on the side of the first refrigerant piping are coupled with the end portions of the first refrigerant piping and end portions on the side of the connecting pipe are coupled with the connecting pipes on the side of the first refrigerant piping.

The two on-off valves are thus smoothly provided in the first refrigerant piping in the standard heat exchanger, in other words, in an already-existing heat exchanger which is not provided with two on-off valves in the first refrigerant piping.

It is also available that the two on-off valves in the first refrigerant piping may be arranged at connecting points with two connecting pipes and each on-off valve is to be formed of the first connection member and the second connection member which are detachable with each other, being aligned along the refrigerant flow forming inside a continuous channel through which the refrigerant can flow so that the continuous channel can be opened or closed by means of valve elements provided respectively in the first connection member and the second connection member.

When the continuous channel of the first connection member and the second connection member is closed by both valve elements wit separating the connection members with each other, the connecting pipes can be removed from the first refrigerant piping, each refrigerant being kept in the first, the second refrigerant piping and in the connecting pipes. And the heat exchanger is transferred to a new place without dismantling the connecting pipes from the second refrigerant piping, and after connecting the first connection member with the second connection member, all the refrigerant used at the original place can be reused at the new place. Or, in case the heat exchanger is carried to a refrigerant recovery site, all the refrigerant can be recovered.

When the two on-off valves in the first refrigerant piping are to be formed of the first connection member and the second connection member, it is preferable that each valve element is so designed as to receive stress from a resiliently biased member respectively provided in the continuous channel of the first connection member and the second connection member so that each valve element is forced to come near to each other by the stress being received by the valve element from the resiliently biased member. When the first connection member and the second connection member are separated with each other, each valve element closes the continuous channel by the stress of the resiliently biased member and when the first connection member and the second connection member are connected with each other, the valve element opens the continuous channel by the reciprocal pushing force against the stress of the resiliently biased member.

Thus, when the first connection member and the second connection member are connected or separated with each other, the continuous channel in each connection member is coordinately opened and shut so that the operation can be smoothly achieved.

In order to seal the refrigerant in the first, second refrigerant piping, and the connecting pipes, the heat exchanger may be structured as will be described next.

The two on-off valves provided in the second refrigerant piping are the first on-off valves which are arranged at end portions of the second refrigerant piping. The second on-off valves which are joined in a detachable manner with the first on-off valves are newly provided at end portions of the two connecting pipes on the side of the second refrigerant piping. The two on-off valves in the first refrigerant piping are the third on-off valves which are arranged at end portions of the first refrigerant piping. The fourth on-off valves which are joined in a detachable manner with the third on-off valves are newly provided at end portions of the two connection pipes on the side of the first refrigerant piping.

Closing all the on-off valves from the first to the fourth results in sealing each refrigerant in the first, the second refrigerant piping and the connecting pipes.

When the heat exchanger is transferred from an original place to a new place, all the on-off valves are closed before the transfer of the heat exchanger, the connecting pipes are removed from the first refrigerant piping and the second refrigerant piping through separation of the first on-off valves from the second on-off valves, the third on-off valves from the fourth on-off valves. After the transfer of the heat exchanger, the connecting pipes are reconnected with the first refrigerant piping and the second refrigerant piping through connection of the first on-off valves with the second on-off valves, the third on-off valves with the fourth on-off valves. Then all the valves are opened. Through the steps above described, all the used refrigerant before the transfer can be reuse after the transfer, even though the connecting pipes are dismantled from the first and the second refrigerant piping for the transfer.

When the heat exchanger is disposed of, all the on-off valves are closed before the disposal of the heat exchanger, and the connecting pipes are removed from the first and the second refrigerant piping through separation of the first on-off valves from the second on-off valves, the third on-off valves from the fourth on-off valves. After the heat exchanger is carried to a refrigerant recovery site, the refrigerant is recovered from the first, the second refrigerant piping and the connecting pipes. Then, the heat exchanger can be disposed of. Thus, through the steps above described, all the refrigerant can be recovered, even though the connecting pipes are dismantled when the heat exchanger is carried to the refrigerant recovery site.

The heat exchanger may also be structured as follows.

Two on-off valves in the second refrigerant piping are arranged at end portions of the second refrigerant piping on the side of the two connecting pipes and two of-off valves in the first refrigerant piping are arranged at end portions of the first refrigerant piping on the side of the two connecting pipes. At least either two on-off valves in the first refrigerant piping or in the second refrigerant piping are provided with a connecting port which is connectable with a refrigerant recovery instrument and a refrigerant supply instrument. The connecting port is so designed as to keep continuous in the channel between the port and the connecting pipe even when the continuous channel of the connecting pipe with a refrigerant piping provided with the on-off valve having the connecting port is closed, in other words, the on-off valve is closed.

When the heat exchanger is transferred from an original place to a new place, the four on-off valves are closed before the transfer of the heat exchanger, the refrigerant in the connecting pipes is recovered through connecting the connecting port to a refrigerant recovery instrument. The connecting pipes are removed from the first refrigerant piping and the second refrigerant piping, and after the transfer of the heat exchanger the connecting pipes are reconnected with the first and the second refrigerant piping. The refrigerant supply instrument is connected to the connecting port to supply the refrigerant into the connecting port and the four on-off valves are then opened. The transfer of the heat exchanger can be thus accomplished without any leakage of the refrigerant from the first, the second refrigerant piping and the connecting pipes.

Incidentally, the recovery of refrigerant in the connecting pipes using a refrigerant recovery instrument can be also available in case of disposal of a heat exchanger. Concretely, four valves are closed before the heat exchanger is carried to a refrigerant recovery site and the refrigerant in the connecting pipes is recovered with the refrigerant recovery instrument. Then the connecting pipes are removed from the first and the second refrigerant piping. The refrigerant in the first refrigerant piping of the interior instrument and the refrigerant in the second refrigerant piping of the exterior instrument are recovered at the refrigerant recovery site, then the heat exchanger is disposed of.

As an another embodiment of a heat exchanger relating to the present invention besides above described, having a separate interior instrument and a separate exterior instrument, a first refrigerant piping arranged in the interior instrument and provided with an interior heat exchanger, a second refrigerant piping arranged in the exterior instrument and provided with an exterior heat exchanger, two connecting pipes which connect to the first refrigerant piping and the second refrigerant piping forming a refrigerant circulating channel in which the refrigerant circulates, and two on-off valves separately arranged in the second refrigerant piping on upper reaches and lower reaches of the refrigerant flow through the exterior heat exchanger is provided with at least one on-off valve on each connecting pipe at some midpoint along the length of the pipe.

When all on-off valves are closed, the refrigerant in the first refrigerant piping and the refrigerant in the connecting pipes from the on-off valve toward the first refrigerant piping and the refrigerant in the second refrigerant piping between two on-off valves are sealed in.

When the heat exchanger is removed from an original place to a new place, two on-off valves of the second refrigerant piping and at least one on-off valve in each connecting pipe are closed before the transfer of the heat exchanger and the connecting pipes are cut at the position from the closed on-off valve toward the exterior instrument. After the transfer of the heat exchanger, the connecting pipes are restored. Then, the refrigerant amounted to the shortage of the refrigerant is supplied into the connecting pipes and two on-off valves, and then the closed on-off valve are opened. Through the steps above described, most of the refrigerant used at the original place can be reused at the new place.

When the heat exchanger is disposed of, two on-off valves in the refrigerant piping and at least one on-off valve in each connecting pipe are closed. The connecting pipes are cut at the position from the closed on-off valve toward the exterior instrument. After the heat exchanger is carried to a refrigerant recovery site, the refrigerant in the first, the second refrigerant piping and the refrigerant from the connecting pipes are recovered, then the heat exchanger is disposed of. Through these steps, most of the refrigerant in the heat exchanger can be recovered.

It is suitable for a heat exchanger, for instance for an air conditioner in a building, having long connecting pipes, to provide on-off valves in each connecting pipes. And when the connecting pipes are provided with a plurality of on-off valves at predetermined intervals, the connecting pipes can be cut at any point in accordance with the situation of the air conditioner in a building so that most of the refrigerant in the connecting pipes can be reused at the new place or can be recovered at the refrigerant recovery site in case of transfer or disposal.

It is also available to insert an extension pipe to a connecting point or shorten the connecting pipe to cut the extra length in accordance with the length required for reconnection of the connecting pipes to operate again a heat exchanger including an air conditioner at a new place after transfer.

In the heat exchanger relating to the present invention having at least one on-off valve in each connecting pipe, two on-off valve may be separately arranged in the first refrigerant piping on upper reaches and lower reaches of the refrigerant flow through an interior instrument. The providing of the two on-off valves prevents from escape of the refrigerant in the first refrigerant piping at least between the two on-off valves, when the connecting pipe is damaged in an accident during the transfer of the heat exchanger to a new place or to a refrigerant recovery site with the connecting pipes being kept connected to the first refrigerant piping.

In the above description, transfer of a heat exchanger from an original place to a new place includes a direct transfer of the heat exchanger to a new place, and indirectly transfer of the heat exchanger first to other place, for instance, an warehouse of a company where leased or rented heat exchangers are stored and from there to the new place.

Incidentally, it is preferable that at least one on-off valve provided on each connecting pipe at some midpoint thereof in the longitudinal direction along the connecting pipe is detachably formed of a first connection member and a second connection member aligned along a flow direction of the refrigerant, forming inside a continuous channel through which the refrigerant can flow. The continuous channel can be opened or closed by means of valve elements respectively provided in the first connection member and the second connection member. Each valve is so designed as to receive a stress from a resiliently biased member respectively arranged in the continuous channel of the first connection member and the second connection member so that each valve element is forced to come near to each other by the stress from the resiliently biased member. When the first connection member and the second connection member are separated from each other, each valve element closes the continuous channel by the stress from the resiliently biased member and when the first connection member and the second connection member are connected with each other, the valve element opens the continuous channel through the reciprocal pushing force against the stress of the resiliently biased member.

Through the above steps, the separation of the first connection member from the second connection member is equivalent to the cut of the connecting pipe and the separation can be carried out without any leakage of the refrigerant.

The present invention explained above can be applied for any heat exchanger having a separated interior instrument and exterior instrument, and is applicable for various air conditioner, for instance, for structure such as housing and building, for trains, for cars, for ships, and for airplanes and further applicable for freezers and refrigerators (including use for vehicles such as ships) for foods such as fish, vegetables and meats.

In a case that the heat exchanger is an air conditioner for building, the interior instrument may be a floor type, a ceiling type or a wall type.

And the present invention is also applicable to a multiple type heat exchanger which is formed of one exterior instrument for a plurality of interior instruments. In the multiple type heat exchanger, connecting pipes arranged between an interior instrument and an exterior instrument has one or a plurality of distributor at some midpoint of the connecting pipes. From the distributor the connecting pipes extend into two distributing pipes for each interior instrument. In the multiple type heat exchanger, the previously described two connecting pipes connecting the first refrigerant piping and the second refrigerant piping to form a refrigerant circulating channel are connecting pipes between one interior instrument and one exterior instrument and the present invention includes the case that the distributor is inserted at some midpoint of the connecting pipe.

DETAILED DESCRIPTION OF THE PREFERRED EMBODIMENT(S)

In explanation of each embodiment of the present invention, same designation is applied to the same or similar components having the same function in the present invention, so that the description will be omitted or simplified. Incidentally, a heat exchanger in each embodiment is an air conditioner for structure.

Figure 1:
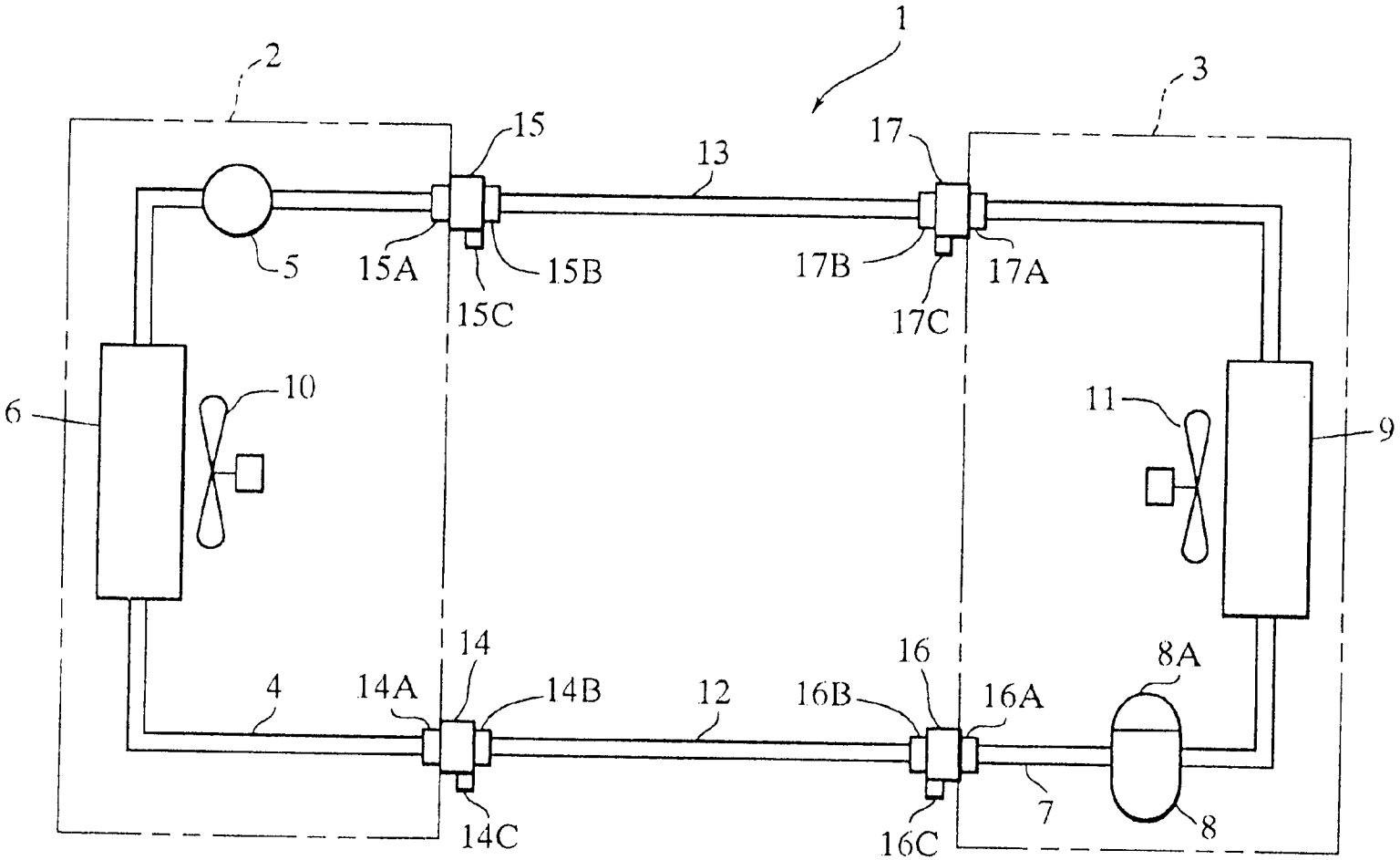
FIG. 1 is a schematic view of a circuit of an air conditioner relating to the first embodiment.

In FIG. 1 showing the first embodiment, the air conditioner 1 consists of a separated interior instrument 2 and exterior instrument 3. A first refrigerant piping 4 being laid in the interior instrument 2, is installed with an expander 5 made of capillary tubes and an interior heat exchanger 6. And a second refrigerant piping 7 being laid in the exterior instrument 3, is installed with a compressor 8 and an exterior heat exchanger 9. Fans 10 and 11 are placed adjacent to the interior heat exchanger 6 and the exterior heat exchanger 9. The first refrigerant piping 4 and the second refrigerant piping 7 are connected with two connecting pipes 12 and 13 to form a refrigerant circulating channel where the refrigerant circulates in the whole air conditioner 1.

The second refrigerant piping 7 is provided with a four-way change valve 8A by which the air conditioner 1 can be changed into cooling mode or heating mode. In cooling mode, the exterior heat exchanger 9 works as a condenser, and the interior heat exchanger 6 works as an evaporator. In heating mode when flow direction of the refrigerant is opposite to that in cooling mode, the exterior heat exchanger 9 works as an evaporator and the interior heat exchanger 6 works as a condenser. Though not shown in the drawing, an auxiliary heater for in heating is optionally placed close to the interior heat exchanger 6.

At the both ends of the first refrigerant piping 4 which connects to the connecting pipes 12 and 13, on-off valves 14 and 15 are separately provided on upper and lower reaches of the interior heat exchanger through which refrigerant flows. At the both ends of the second refrigerant piping 7 which connects to the connecting pipes 12 and 13, on-off valves 16 and 17 are separately provided placing on the upper and lower reaches of the exterior heat exchanger through which refrigerant flows.

Figure 2:
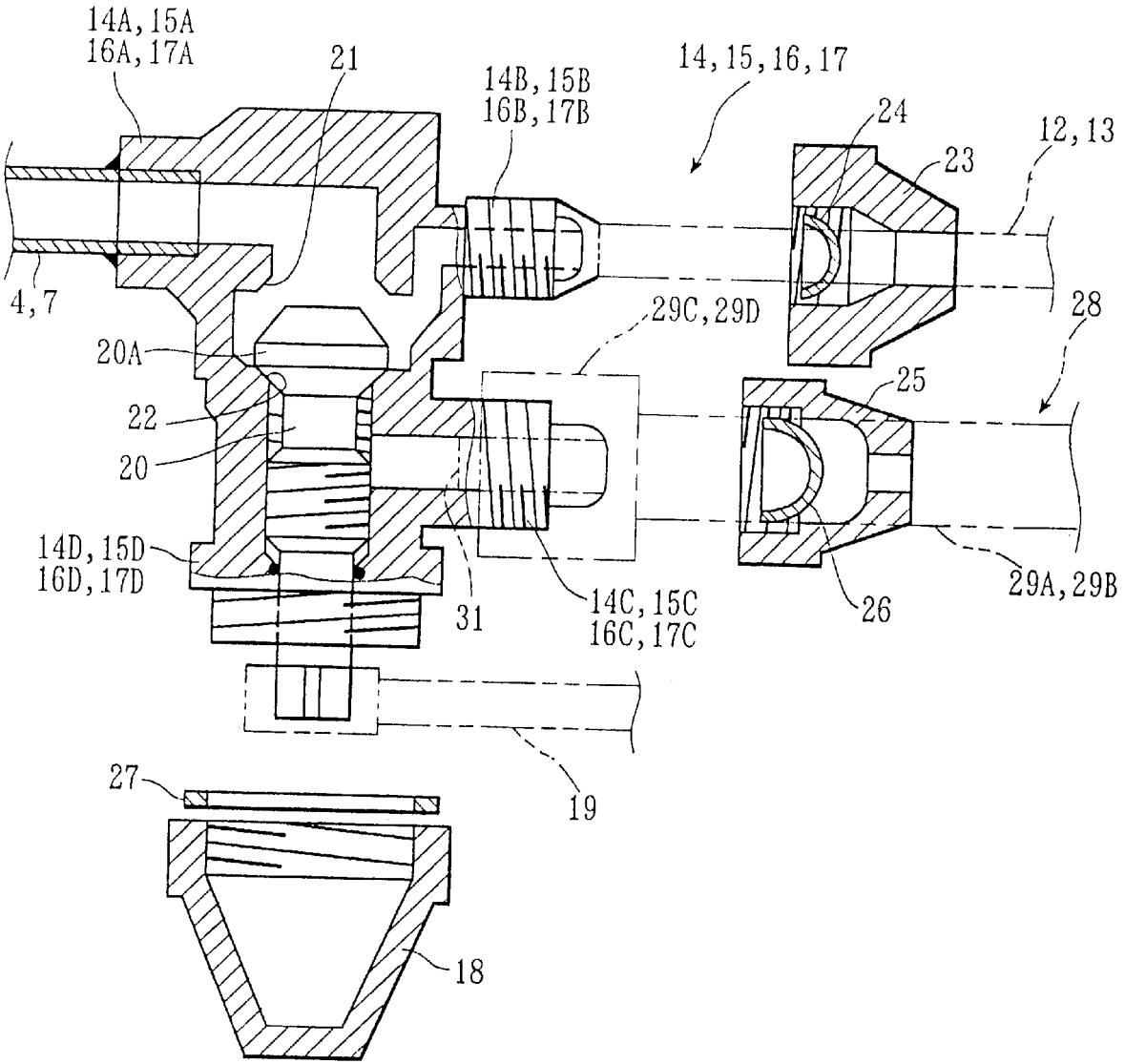
FIG. 2 is a sectional view of an internal structure of a three-port valve which is the on-off valve shown in FIG. 1.

In FIG. 2, internal structure of the on-off valves 14, 15, 16, and 17 are shown. The valves 14 to 17 have the same structures. The on-off valves 14 to 17 are three-port valves each of which has connecting port 14A, 15A, 16A or 17A joining to the end of the refrigerant piping 4 or 7, connecting port 14B, 15B, 16B or 17B joining to the connecting pipe 12 or 13, and connecting port 14C, 15C, 16C or 17C joining to a refrigerant supply instrument which will be described later. The on-off valve 14–17 has a valve element 20 which is advanced or retreated by turning with a tool 19 such as a wrench while a cap 18 is dismantled. When the valve element 20 is advanced and the head 20A having a larger diameter portion is touched to a valve seat 21 at the front thereof, the stream between the connecting port 14A, 15A, 16A, 17A and the connecting port 14B, 15B, 16B, 17B is respectively shut off, consequently the on-off valve 14–17 is closed. When the valve element 20 is retreated and the head 20A is touched to a valve seat 22 at the back thereof, the stream between the connecting port 14A, 15A, 16A, 17A and the connecting port 14B, 15B, 16B, 17B is respectively opened, consequently the on-off valve is opened. And in the case that the valve element is positioned at the middle of advance limit and retreat limit, three connecting ports are opened through with each other.

When the valve element 20 is touched to the valve seat 21 at the front thereof thus closing the on-off valve 14 to 17, the respective stream between the connecting port 14B, 15B, 16B, 17B and the connecting port 14C, 15C, 16C, 17C is still maintained, accordingly the connecting pipes 12, 13 joining to the connecting port 14B, 15B, 16B, 17B are respectively opened through with the connecting port 14C, 15C, 16C, 17C.

The connecting port 14B, 15B, 16B, 17B, when not connected to the connecting pipe 12, 13, is able to be closed without any leakage of the refrigerant by means of a seal member 24 fixed with a nut 23. The connecting port 14C, 15C, 16C, 17C, when not connected to the refrigerant recovery instrument, is also able to be closed without any leakage of the refrigerant by means of a seal member 26 fixed with a nut 25. When the connecting port 14B, 15B, 16B, 17B, is connected with the connecting pipe 12, 13, the seal member 24 and the nut 23 are dismantled, and a flared end of the connecting pipe 12, 13 is connected to the connecting port 14B, 15B, 16B, 17B with the same nut 23. When the valve element 20 is not required to be driven with the tool 19, a screw barrel member 14D, 15D, 16D, 17D of the on-off valve 14, 15, 16, 17 from where a heel of the valve element 20 is projecting is screwed up with the cap 18 through a packing 27 which serves to prevent leakage of the refrigerant.

While the air conditioner 1 is in operation, the on-off valves 14 to 17 are open and the refrigerant is thus circulating endlessly through in the above explained refrigerant circulating channel formed with the first refrigerant piping 4, the connecting pipes 12, 13 and the second refrigerant piping 7. when a leased or a rented air conditioner 1 is transferred from the original place to a new place at the expiration of the contract, the on-off valves 14 to 17 are closed, to seal the residual refrigerant in the first refrigerant piping 4 and the second refrigerant piping 7 The connecting pipes 12 and 13 are removed from the on-off valves 14 to 17, the connecting ports 14B, 15B, 16B and 17B are sealed with the seal members 24 which are fixed with the nuts 23. Accordingly, the interior instrument 2, the exterior instrument 3 and the connecting pipes 12 and 13 are smoothly carried to the new place.

Figure 3:
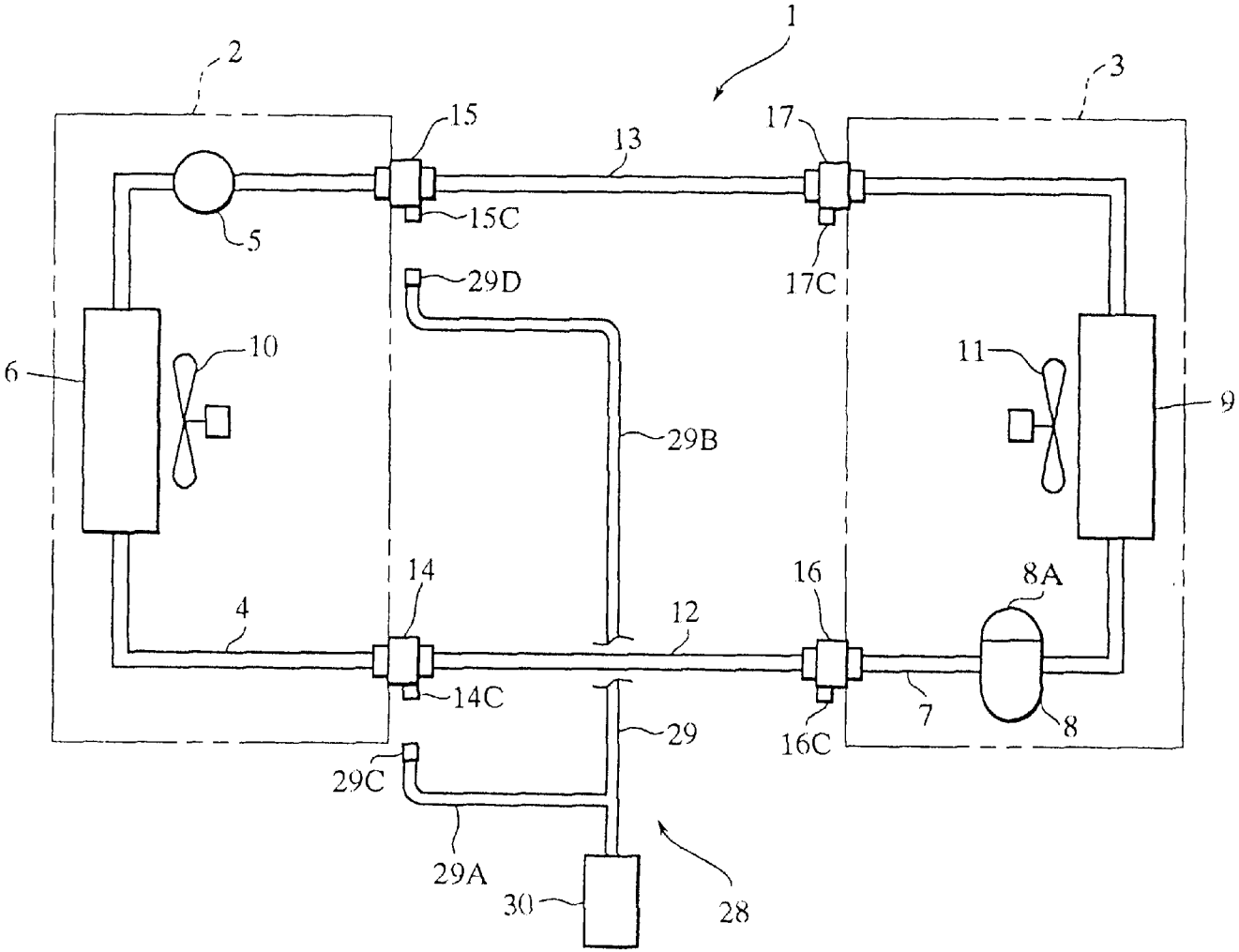
FIG. 3 is a schematic view of a work in supplying refrigerant into the air conditioner in FIG. 1 at a new place.

At the new place, the interior instrument 2 and the exterior instrument 3 are first installed at an appropriate place. The nuts 23 and the seal members 24 are removed from the connecting ports 14B, 15B, 16B, 17B, and both ends of the connecting pipes 12, 13 are connected to the connecting ports by means of the nuts 23, so that the first refrigerant piping 4, the second refrigerant piping 7 and the connecting pipes 12, 13 are again connected with one another through the on-off valves 14 to 17. Next, the nuts 25 and the seal members 26 are removed from the connecting ports 14C, 15C, 16C, 17C of the on-off valves 14 to 17 and either of the connecting ports 14C, 15C or 16C, 17C, that is, the connecting ports 14C, 15C shown in FIG. 3 as an example according to the present invention are connected with connecting sockets 29C, 29D provided at forward ends of branch pipes 29A, 29B of a supply pipe 29 extending from a refrigerant supply instrument 28. Accordingly, the refrigerant stored in a refrigerant reserve tank 30, such as a cylinder, of the refrigerant supply instrument 28 is fed, with an internal pressure of the tank 30, into the connecting pipes 12, 13 through the on-off valves 14, 15 to which the connecting sockets 29C, 29D are connected. At this moment, an air remained inside the connecting pipes 12, 13 is sufficiently discharged, in proportion to the refrigerant fed therein, from the connecting ports 16C, 17C of the on-off valves 16, 17 to which the connecting sockets 29C, 29D are not joined. The connecting ports 16C, 7C are finally sealed with a combination of the seal members 26 and the nuts 25.

The air conditioner 1 is now ready for a test operation which starts from opening the on-off valves 14 to 17. The temperature difference of between the air breathed into an air inlet port of the interior instrument 2 and the air blowing out from a blow-off outlet being is repeatedly detected until the thus-detected temperature difference reaches at a specified value by continuously feeding the refrigerant from the refrigerant supply instrument 28 to the refrigerant circulating channel. When detecting the specified value, the connecting sockets 29C, 29D are removed from the connecting ports 14C, 15C of the on-off valves 14, 15, and the connecting sockets are sealed with the seal members 26 and the nuts 25.

As shown by imaginary lines (=two-dotted lines) in FIG. 2, there is provided valve cores 31 inside the connecting ports 14C, 15C, 16C, 17C of the on-off valves 14 to 17. The valve core 31 is adapted to close channels of the connecting port 14C, 15C, 16C, 17C by resilient force of the spring when the connecting socket 29C, 29D is not joined thereto as a usual state, and when the connecting socket 29C, 29D is joined, it is opened by insertion of a projection provided inside the connecting socket 29C, 29D to open the channels of the connecting port 14C, 15C, 16C, 17C (See a valve core of a manifold shown in FIG. 23 ), so that the wasteful leakage of the refrigerant can be prevented at the time when the connecting socket 29C, 29D is removed from the connecting port 14C, 15C of the on-off valve 14, 15.

In such case that the valve core 31 is provided inside the connecting ports 14C, 15C, 16C, 17C, , the nuts 25 and the seal members 26 are removed from either connecting ports 14C, 15C or 16C, 17C at the new place of the air conditioner 1, and connecting sockets of an air suction system mainly formed of a vacuum pump may be joined to the connecting ports thus chosen. Here, the same protrusion as that inside the connecting sockets 29C, 29D are provided inside the sockets of the air suction system. The air remained inside the connecting pipes 12, 13 is thus sucked and discharged, and the connection sockets 29C, 29D of the refrigerant supply instrument 28 are connected again to the above described connecting ports so that the refrigerant can be supplied.

As above, the air conditioner can be operated at the new place. The operation can be resumed reusing the refrigerant which is sealed in the first refrigerant piping 4 and the second refrigerant piping 7 at the prior place. It is therefore available, at the new place, only to fill the short refrigerant equal to the inside volume of the connecting pipes 12 and 13.

Incidentally, as in the present embodiment, the provision of the connecting ports 14C, 15C, 16C, 17C which can be joined with the connecting sockets 29C, 29D of the air suction system and the refrigerant supply instrument 28, to all the on-off valves 14 to 17 of the first refrigerant piping 4 and the second refrigerant piping 7, helps to select the connecting ports to which the connecting sockets 29C, 29D of the air suction system and the refrigerant supply instrument 28 can be joined, in accordance with the situation of the installation for the interior instrument 2 and the exterior instrument 3 at the new place.

Figure 4:
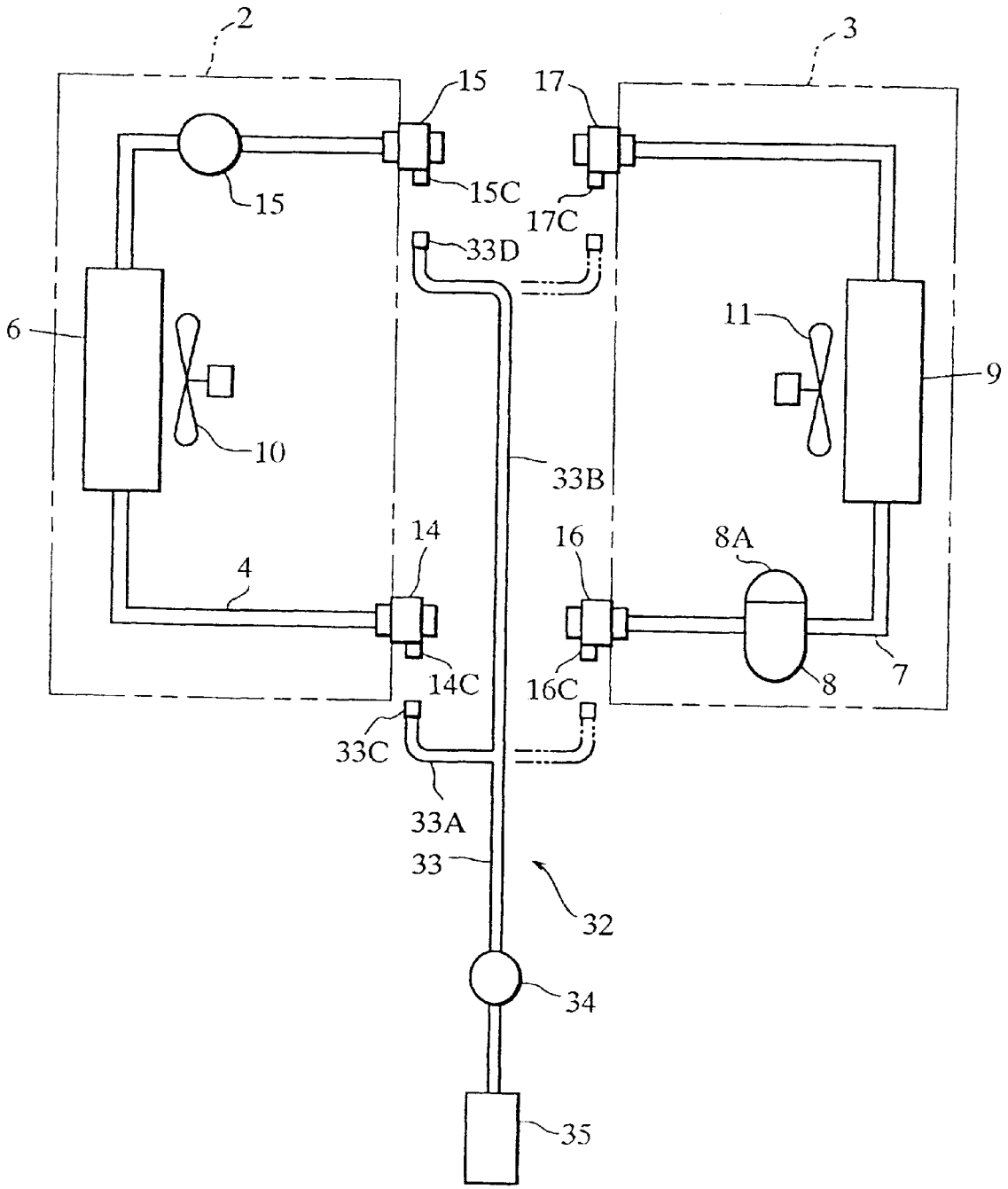
FIG. 4 is a schematic view of a work in recovering refrigerant from the air conditioner in FIG. 1 at a refrigerant recovery site.

In such case that the air conditioner 1 is disposed of for wear and tear, all the on-off valves 14 to 17 are closed, and the connecting pipes 12, 13 are removed. The interior instrument 2 and the exterior instrument 3 are carried to a refrigerant recovery site, and as shown in FIG. 4, the connecting ports 14C, 15C of the on-off valves 14, 15 are connected with connecting sockets 33C, 33D provided at the forward end of branch pipes 33A, 33B diverged from a recovery pipe 33 of a refrigerant recovery instrument 32, so that the refrigerant in the first refrigerant piping 4 is recovered in a cylinder 35 by means of a suction pump 34 of the refrigerant recovery instrument 32. The connecting sockets 33C, 33D are connected to the connecting ports 16C, 17C of the on-off valves 16 and 17 in the same way, and the refrigerant in the second refrigerant piping 7 can be recovered in the cylinder 35. Thus, the refrigerant remained in the first refrigerant piping 4 and the second refrigerant piping 7 of all the refrigerant in the refrigerant circulating channels of the air conditioner 1 can be recovered.

The recovery of the refrigerant from the first refrigerant piping 4 and the second refrigerant piping 7 may be performed by coupling a connecting socket at the forward end of a single pipe 33 with no branch to either of the on-off valves 14 or 15 and 16 or 17. It can be said that only provision of connecting ports which can be coupled with a connecting socket of the recovery pipe 33 for at least either of the on-off valves 14 or 15, and 16 or 17 is enough.

Figure 5:
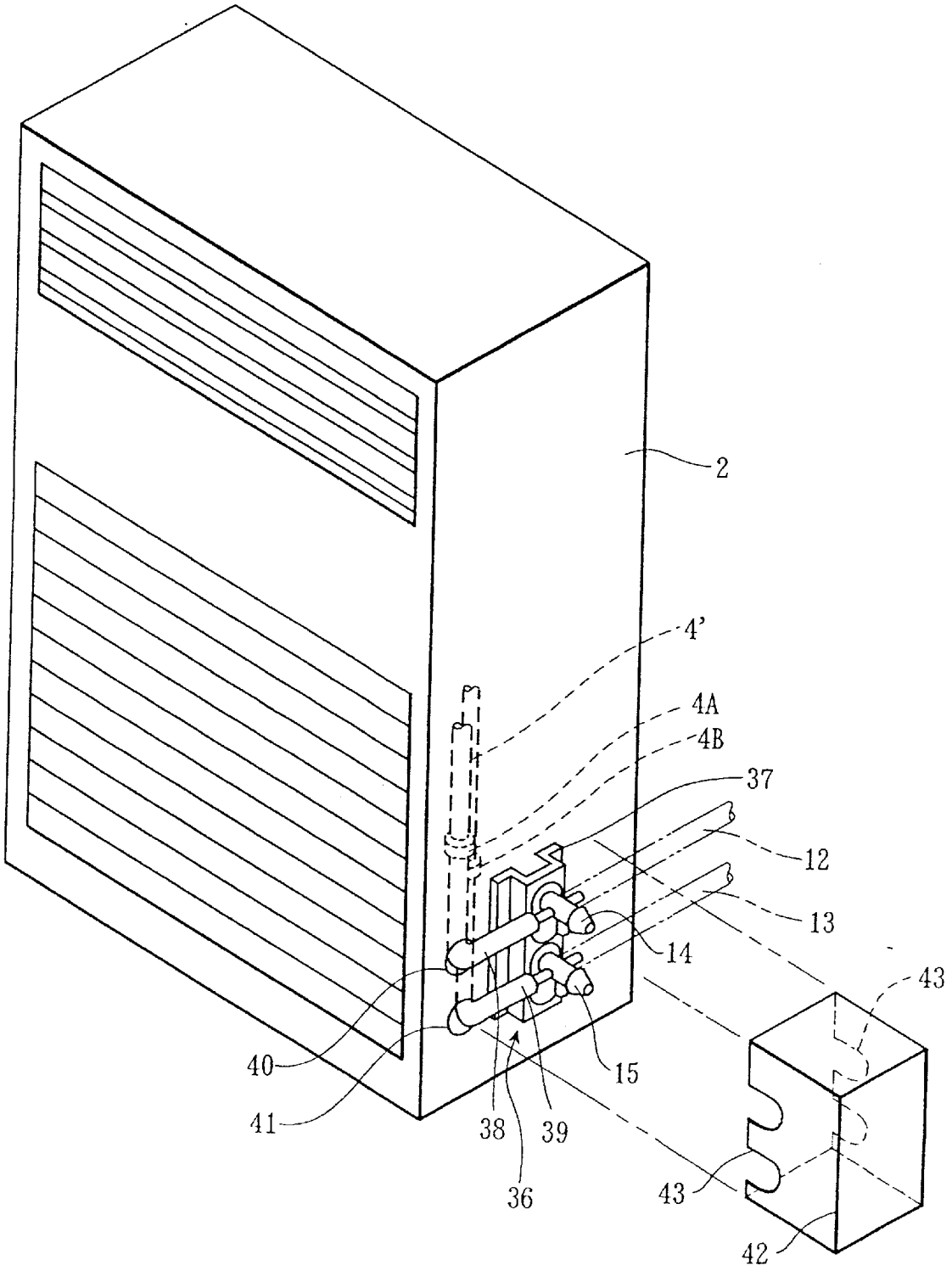
FIG. 5 is a perspective view of an interior instrument to which two on-off valves are attached as an integrally connected unit.

FIG. 5 shows a specific structure for installation of the two on-off valves 14, 15 provided to the first refrigerant piping 4 laid in the interior instrument 2. The on-off valves 14 and 15 are unified into a unit 36 installed on the lower part of the outside surface of the floor type interior instrument 2. The unit 36 is formed of the two on-off valves 14, 15 and a mount 37 supporting the on-off valves 14, 15. In the present embodiment, the unit 36 further includes supplementary refrigerant pipes 38, 39 which extends from ends 4A, 4B of main pipes 4' of the first refrigerant piping 4 to the on-off valves 14, 15. The on-off valves 14, 15, the mount 37 and the supplementary refrigerant pipes 38, 39 are assembled into the unit 36 before installation on the interior instrument 2 and the thus-assembled unit 36 is fixed to the interior instrument 2 through mounting of the mount 37 with bolts and nuts. As the two on-off valves 14, 15 are beforehand integrated with the mount 37 which also works as a connecting element, the installation of them to the interior instrument 2 is smooth and the maintenance before the installation is also simple.

In such type of the interior instrument 2 as shown in FIG. 5, end portions 4A, 4B of the main pipe 4' of the first refrigerant piping 4 terminate inside the interior instrument 2 or do not protrude outside. Consequently, the supplementary refrigerant pipes 38, 39 are inserted through holes 40, 41 located at lower area of the side surface of the interior instrument 2 to inside the interior instrument 2. In other words, the supplementary refrigerant pipes 38, 39 are for supplement compensating for shortage of he first refrigerant piping 4 until to the on-off valves 14, 15, forming parts of the first refrigerant piping 4, and are bent beforehand in compliance with the bent shape of the shortage of the refrigerant circuit.

Figure 6:
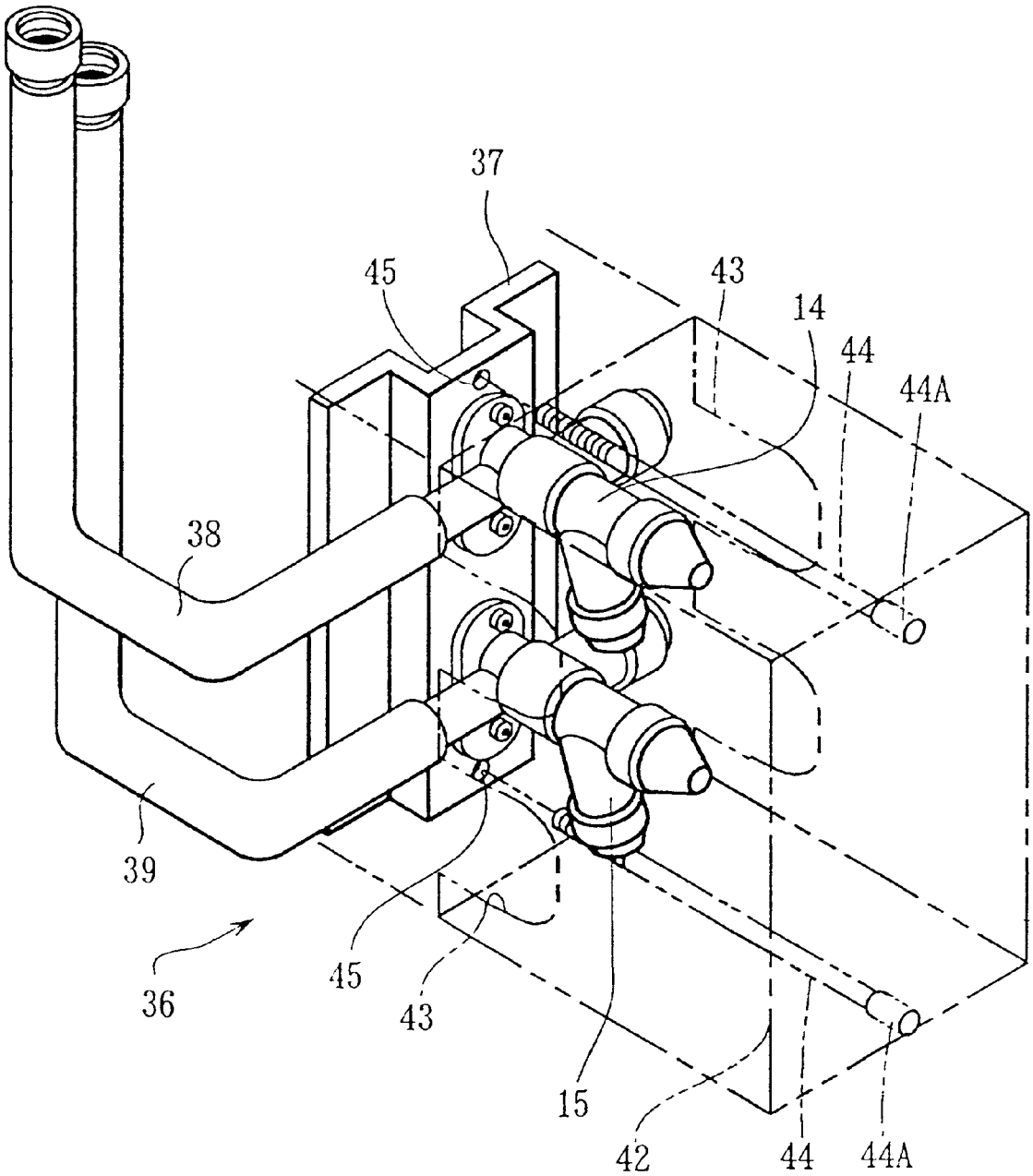
FIG. 6 is an enlarged view of the on-off valves and a periphery thereof in FIG. 5.

A cover 42 of the unit 36 is shown in FIG. 5 and FIG. 6, wherein the cover 42 has a box type appearance, covering the on-off valves 14, 15 and the mount 37 to ensure the safety. The cover has four notches 43 to make ways for the supplementary refrigerant pipes 38, 39 and the connecting pipes 12, 13. As shown in FIG. 6, the cover 42 is fixed to the mount 37 with a set-screw 44 by screwing a head 44A of the set-screw 44 protruding out of the cover 42 and coupling a screw at the other forward end into a screw hole 45 of the mount 37.

The other embodiments shown from FIG. 7 to FIG. 18 will be explained hereinafter. The embodiment is proposed to simply provide two on-off valves to the interior instrument 2 of a standard air conditioner shown in FIG. 7, where the two on-off valves 16, 17 are attached to the second refrigerant piping 7 while two on-off valves are not provided to the first refrigerant piping 4. In the standard air conditioner, the ends of the first refrigerant piping 4 is provided with male screw members 50 fixed thereto and near the first refrigerant piping 4 at the ends of the connecting pipes 12, 13 female screw members 51 which couple with the male screw members 50 are provided in a rotatable manner as shown in FIG. 8.

Figure 9:
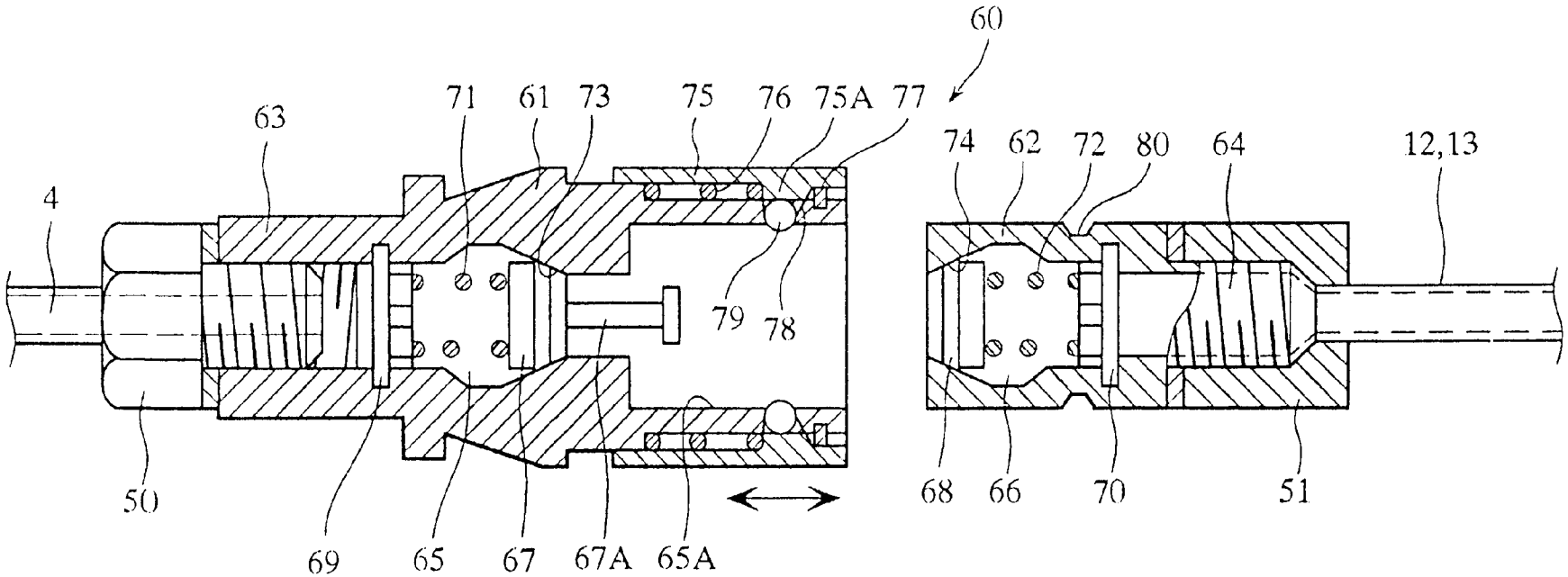
FIG. 9 is a sectional view of the on-off valve formed of two connection members, at present in separation, inserted between the end portions of the refrigerant piping and the connecting pipe shown in FIG. 8.
Figure 10:
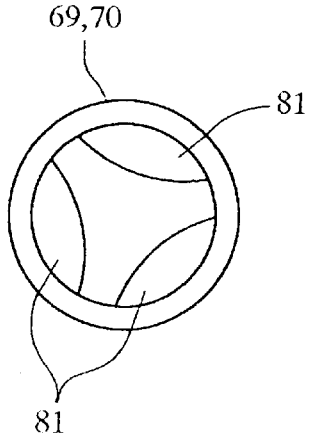
FIG. 10 is a view of a spring bearing shown in FIG. 9.
Figure 11:
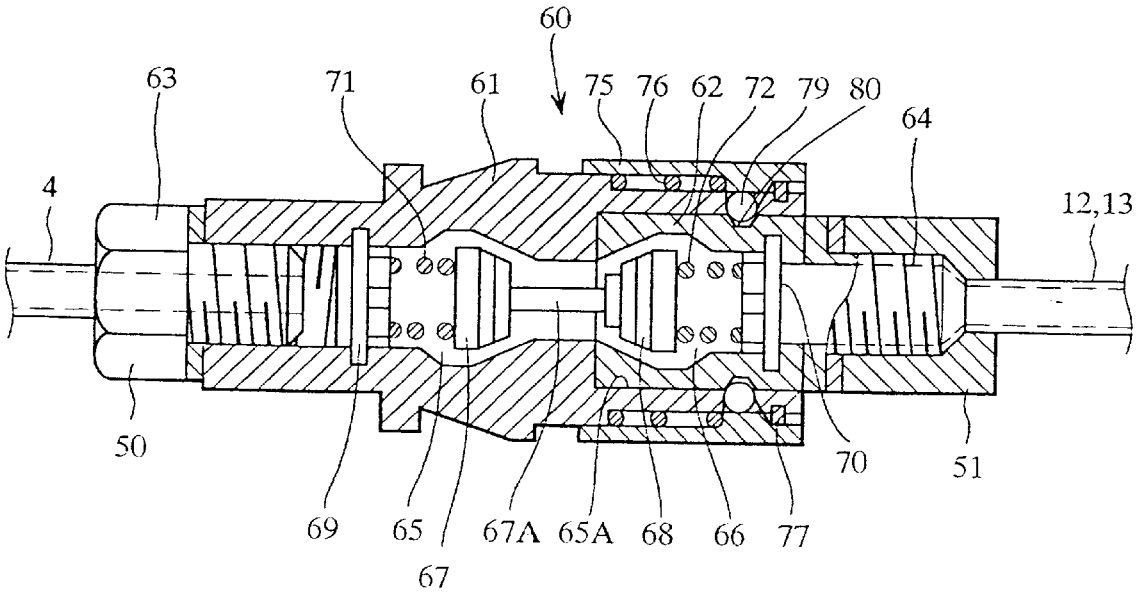
FIG. 11 is a sectional view of the two connection members in FIG. 9, being in connection.

An on-off valve 60 for the first refrigerant piping 4 in the first embodiment is shown from FIG. 9 to FIG. 11. The on-off valve 60 is dettachable, and is formed of a first connection member 61 and a second connection member 62 arranged side by side along the refrigerant flow The end of the first connection member 61 on the side of the first refrigerant piping 4 corresponds with a first end portion 63 of the on-off valve 60. The first end portion 63 is a female screw coupled with the male screw 50 attached at the end of the first refrigerant piping 4. The end of the second connection member 62 on the side of the second refrigerant piping 12, 13 corresponds with a second end portion 64 of the on-off valve 60. The second end portion is a male screw coupled with the female screw 51 attached at the end of the connecting pipe 12, 13. Inside the first and second connection members 61, 62, there is provided a continuous channel 65 through 66 which extends from the first end portion 63 to the second end portion 64. In the continuous channel 65 through 66, valve elements 67 and 68 are set and are always biased to come near to each other by resiliently biased springs 71, 72 received with spring bearings 69, 70. When the first connection member 61 and the second connection member 62 are detached with each other, the valve elements 67, 68 which are movable to-and-fro along a longitudinal direction of the continuous channel 65 through 66, are touched to the valve seats 73, 74 so that the continuous channel 65 through 66 is closed.

On the outer surface of the first connection member 61, a cylindrical member 75 for handling is arranged in a slidable manner in a longitudinal direction of the continuous channel 65. The cylindrical member 75 is always urged toward the second connection member 62 by means of a spring 76 to touch to a stopper 77. On the inner surface of the cylindrical member 75, a protrusion 75A is formed on the second connection member 62. A hole 78 which is tapered off inside, is bored in the first connection member 61 at a position corresponding to that of the protrusion 75A in a state that the cylindrical member 75 is touched to the stopper 77. A ball 79 is inserted into the hole 78. A groove 80 relative to the ball 79 is formed on the outer surface of the second connection member 62.

After sliding the cylindrical member 75 backward to the first refrigerant 4, the second connection member 62 is inserted into a large diameter section 65A at the forward end of the continuous channel 65 of the first connection member 61 as shown in FIG. 11. And when the cylindrical member 75 is slid forward until the stopper 77 by means of the spring 76, the ball 79 pushed out by the protrusion 75A is fits into the groove 80 and the first connection member 61 and the second connection member 63 are thus connected with each other. As a projection 67A extending from the valve element 67 of the first connection member 61 to the second connection member 62, pushes the valve element 68 of the second connection member 62, the valve elements 67, 68 are retreated from initial positions thereof by pushing force opposing with each other, thus the valve elements 67, 68 open the continuous channel 65 through 66. As plural openings 81 are provided in the spring bearing members 69, 70 as shown in FIG. 10, when the valve elements 67, 68 open the continuous channel 65 through 66, the refrigerant flows through the first refrigerant piping 4 to the connecting pipes 12, 13.

In order to release a coupling connection between the first connection member 61 and the second connection member 62 after sliding the cylindrical member 75 backward, the second connection member 62 is drawn apart from the first connection member 61, then the ball 79 is moved out from the groove 80 separating between the connection members 61 and 62.

As has been described, the on-off valve 60 according to the first embodiment is a coupler formed of the two connection members 61 and 62. When the connection members 61 and 62 are detached, the continuous channels 65 through 66 are self-explanatorily closed up by the valve elements 67, 68, while the connection members 61 and 62 are connected, the continuous channels 65 through 66 are fully opened.

Figure 7:
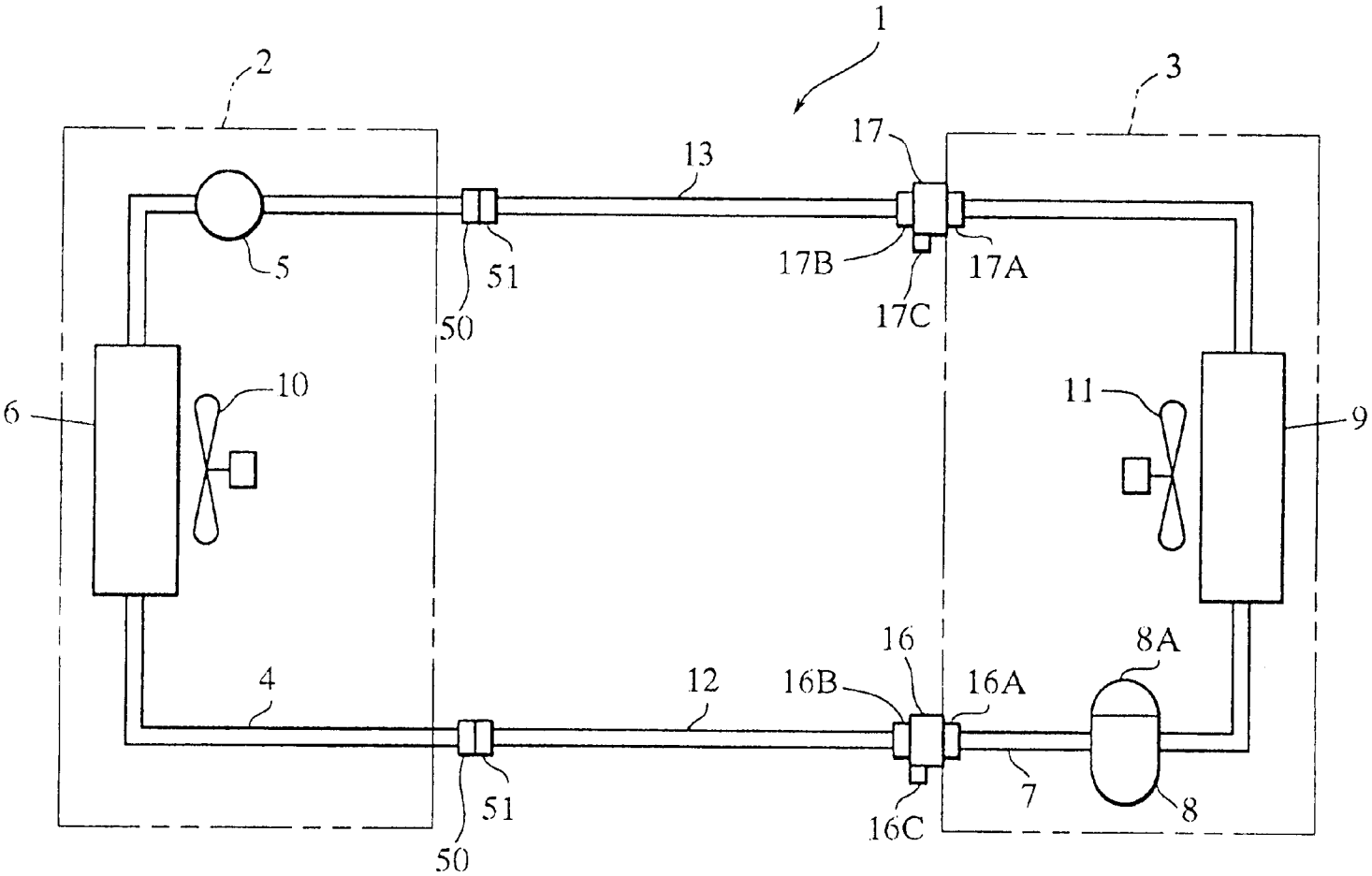
FIG. 7 is a diagrammatic view of a circuit of a standard air conditioner in which on-off valves are not provided in a refrigerant piping of an interior instrument to use for explanation of the air conditioner relating to the second embodiment.
Figure 8:
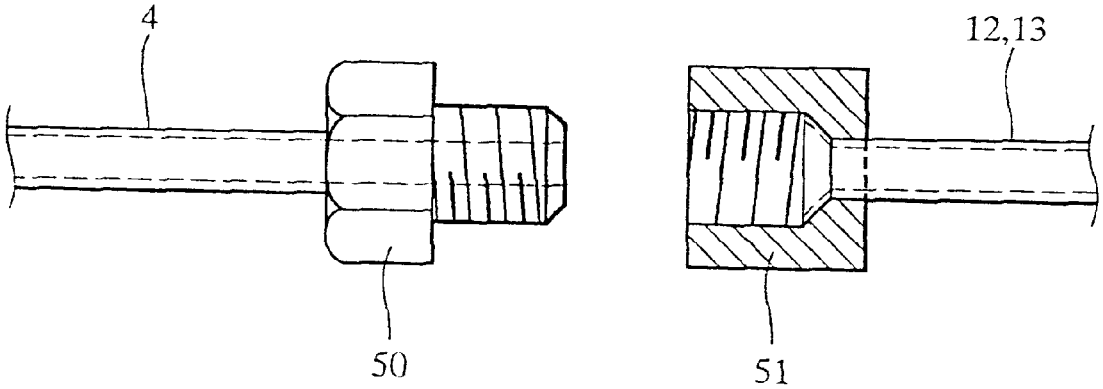
FIG. 8 is a view of an end portion of a refrigerant piping of an interior instrument and an end portion of a connecting pipe.

The on-off valve 60 having such structures and functions, is provided between the male screw member 50 at the end of the first refrigerant piping 4 and the female screw member 51 at the end of the connection pipe 12, 13, of the standard air conditioner shown in FIG. 7

Figure 12:
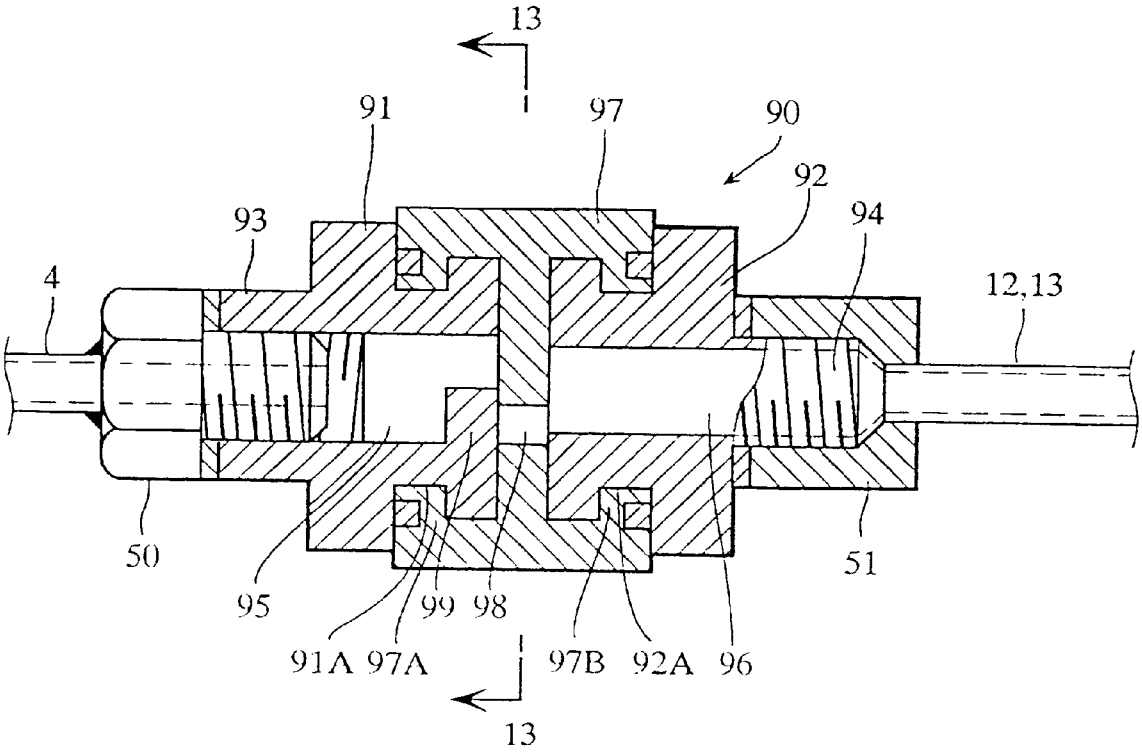
FIG. 12 is a sectional view of an on-off valve of the second embodiment inserted between the two end portions shown in FIG. 8.
Figure 13:
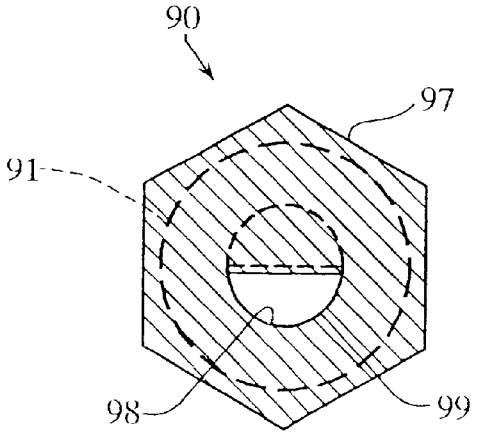
FIG. 13 is a sectional view along the 13—13 line in FIG. 12.

FIGS. 12 and 13 present another on-off valve 90 according to the second embodiment . The on-off valve 90 is assembled with a first connection member 91 and a second connection member 92 coupled to each other. A first end portion 93 of the on-off valve 90 is a female screw which is joined with the male screw 50 of the first refrigerant piping 4, and a second end portion 94 is a male screw which is joined with the female screw 51 of the connection pipes 12, 13. Between the first connection member 91 and the second connection member 92 wherein a continuous channel 95 through 96 is formed, a rotary valve element 97 whose radial direction of the rotation is in a right angled direction against the longitudinal direction of the continuous channel 95 through 96 is intervened. Circular projections 97A and 97B at the both ends of the valve element 97 are coupled in a rotatable manner on circular grooves 91A and 92A of the first connection member 91 and the second connection member 92 respectively, and thus, the connection members 91 and 92 are firmly connected each other through the valve element 97.

As shown in FIG. 13, a nearly semicircular opening 98 is formed in the valve element 97 and a projection 99 which is semicircularly projected into the continuous channel 95 is provided in the first connection member 91. When the opening 98 and the projection 99 coincides with each other by turning the valve element 97, the continuous channels 95 through 96 is closed, and by further turning the valve element 97 the continuous channel 95 through 96 is opened.

Figure 14:
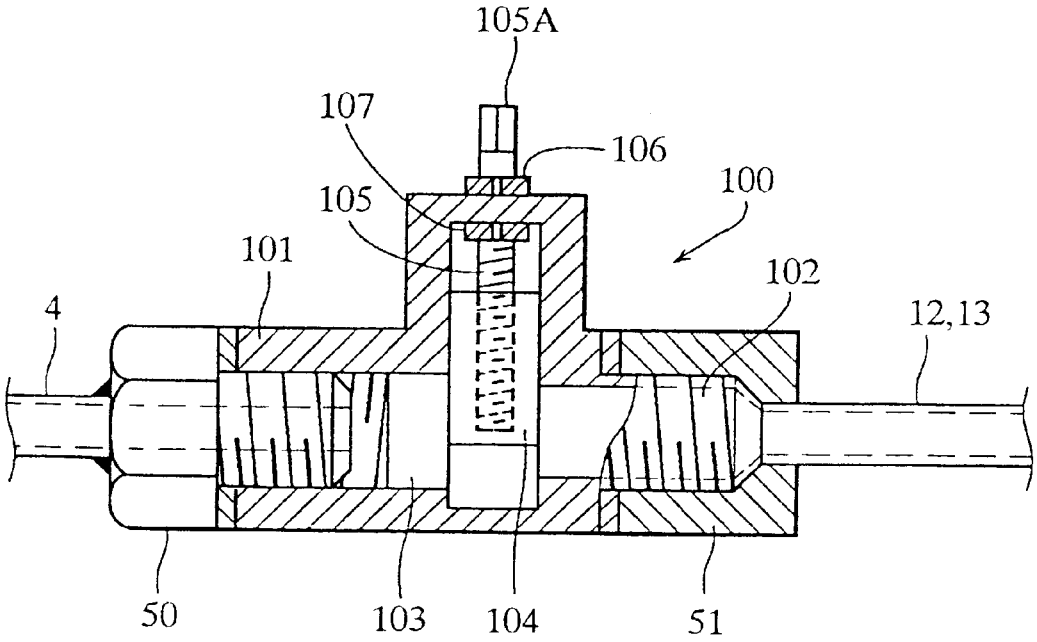
FIG. 14 is a sectional view of an on-off valve of the third embodiment inserted between the two end portions shown in FIG. 8.
Figure 15:
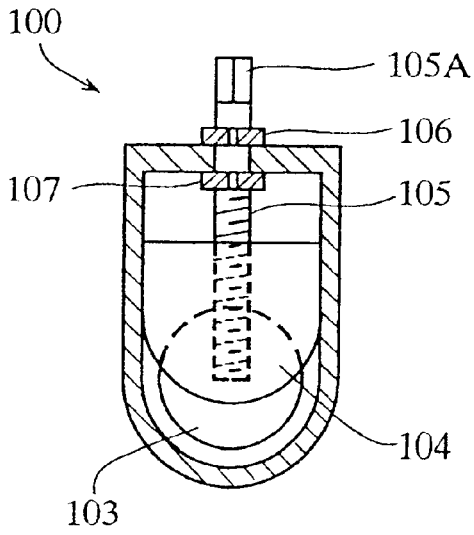
FIG. 15 is a section drawing of a side elevational view of FIG. 14.

Still another on-off valve 100 according to the third embodiment is shown in FIG. 14 and FIG. 15. A first end portion 101 of the on-off valve 100 is a female screw which is coupled with the male screw 50 of the first refrigerant piping 4, and a second end portion 102 is a male screw which is coupled with the female screw 51 of the connection pipe 12 or 13. In the midst of a continuous channel 103 which is formed inside the on-off valve from the first end 101 through the second end 102, a reciprocating motion type valve element 104, which is movable to-and-fro along a right angle direction against the longitudinal direction of the continuous channel 103, is provided. A screw 105 is fastened in the valve element 104, and is prevented from axially movement by means of pressure elements 106, 107. A head 105A of the screw 105 is projected outside the on-off valve 100. By turning the head 105A with a tool, the continuous channel 103 is opened and shut through the movement of the valve element 104.

Figure 16:
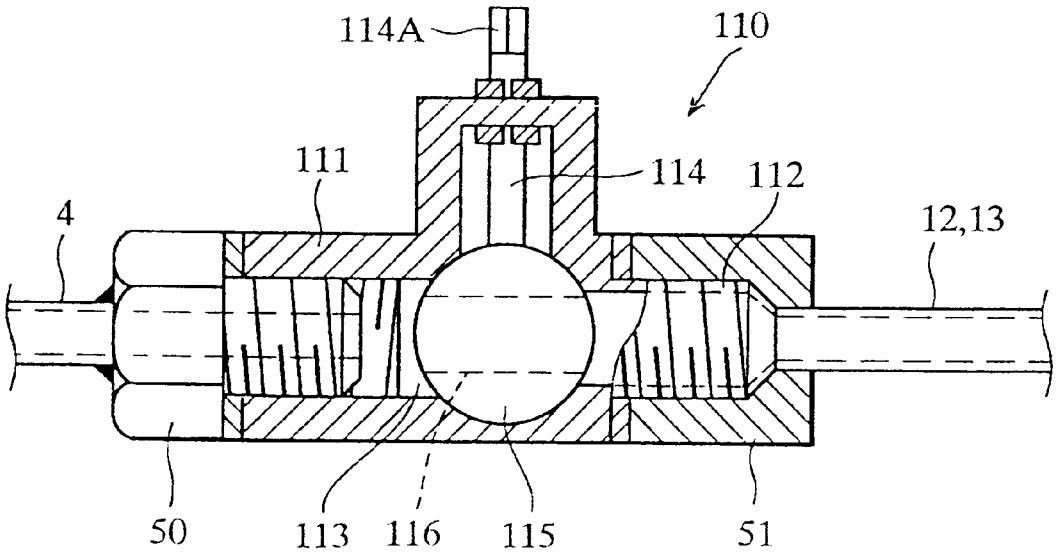
FIG. 16 is a sectional view of an on-off valve of the fourth embodiment inserted between the two end portions shown in FIG. 8.
Figure 17:
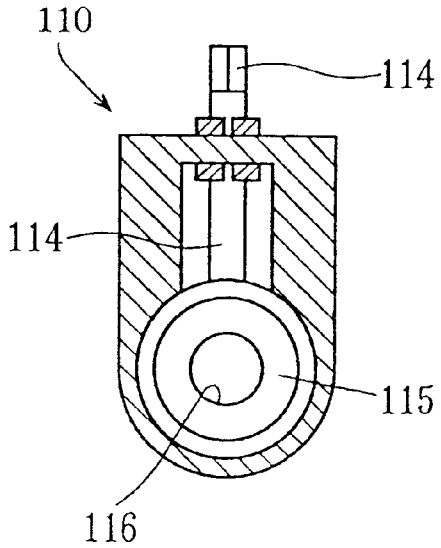
FIG. 17 is a section drawing of a side elevational view of FIG. 16.

Yet another on-off valve according to the fourth embodiment is shown in FIG. 16 and FIG. 17. A first end portion 111 of the on-off valve 110 is a female screw which is coupled with the male screw 50 of the first refrigerant piping 4, and a second end portion 112 is a male screw which is coupled with the female screw 51 of the connection pipe 12, 13. In the midst of a continuous channel 113 which is formed inside the on-off valve 110 from the first end portion 111 through the second end portion 112, a ball rotary valve element 115 is arranged whose axial direction of a rotation center 114 is along a right angle against the longitudinal of the continuous channel 113. A valve element 115 is integrated with a rotation center 114 and a head 114A of the rotation center 114 is projected outside the on-off valve 110. In the valve element 115, a through-hole 116 is provided. When the valve element 115 is adapted to rotate by turning the head 114A of the rotation center 114 with a tool, the continuous channel 113 is opened or shut in accordance with the situation of the through-hole.

As the on-off valve 60, 90, 100 and 110 in each embodiment above described has two end portions at the both ends thereof. That is, the first end portion which can be coupled with the male screw 50 at the end of the first refrigerant piping 4 and the second end portion which can be coupled with the female screw at the end of the connection pipe 12, 13. After pump-down when ready, the male screw 50 and the female screw 51 are detached one from the other and the on-off valve 60, 90, 100, 110 are inserted between the screws 50 and 51. Accordingly, two on-off valves can be provided to the first refrigerant piping 4 of the standard air conditioner.

When an air conditioner in which the on-off valve 60 shown in from FIG. 9 to FIG. 11 is provided at the connection point with the connection pipe 12, 13 of the first refrigerant piping 4 is transferred to a new place at the expiration of a leased or a rented contract or when the air conditioner is disposed of because of wear and tear, the first connection member 61 and the second connection member 62 of the on-off valve 60 are detached. Once detached, since the continuous channel 65 through 66 in the first and the second connection members 61, 62 are closed by the valve elements 67, 68, the refrigerant remained in the first refrigerant piping 4 is sealed in the first refrigerant piping 4 and the refrigerant remained in the second refrigerant piping 7 is also sealed in the second refrigerant piping 7 and the connection pipe 12, 13.

It is also available that after closing the on-off valves 16, 17 of the second refrigerant piping 7, the connecting pipes 12, 13 are detached from the connecting ports 16B and 17B, and only the refrigerant remained in the first refrigerant piping 4 and in the refrigerant piping 7 are sealed.

In such a case that the air conditioner is transferred to a new place, after the air conditioner 1 is transferred to the new place and the interior instrument 2, the exterior instrument 3 are respectively installed at appropriate place, if the connecting pipes 12, 13 are detached from the connecting ports 16B, 17B of the on-off valves 16, 17, the connections between pipes and ports are first restored. And the first connection member 61 and the second connection member 62 of the on-off valve 60 are fairly connected. Thus, the continuous channel 65 through 66 are opened by means of the valve elements 67, 68 in the connection members 61, 62.

In another case that the connecting pipes 12, 13 are detached for the transfer of the air conditioner 1 to a new place, the refrigerant is short in proportion to the internal volume of the connecting pipes 12, 13. The short refrigerant is supplied to the connecting pipes 12, 13, through connecting in turn the connection end of the air charging system and the connection end of the refrigerant supply instrument to the connecting ports 16C, 17C which are provided with the valve core 31 shown in FIG. 2 of the on-off valves 16, 17. Then the on-off valves 16, 17 are opened, and the air conditioner is started. If the connecting pipes 12, 13 are not detached from the on-off valves 16, 17 at the time the air conditioner is transferred to a new place, the operation of the air conditioner can be started by simply connecting the first connection member 61 with the second connection member 62 of the on-off valve 60.

Figure 18:
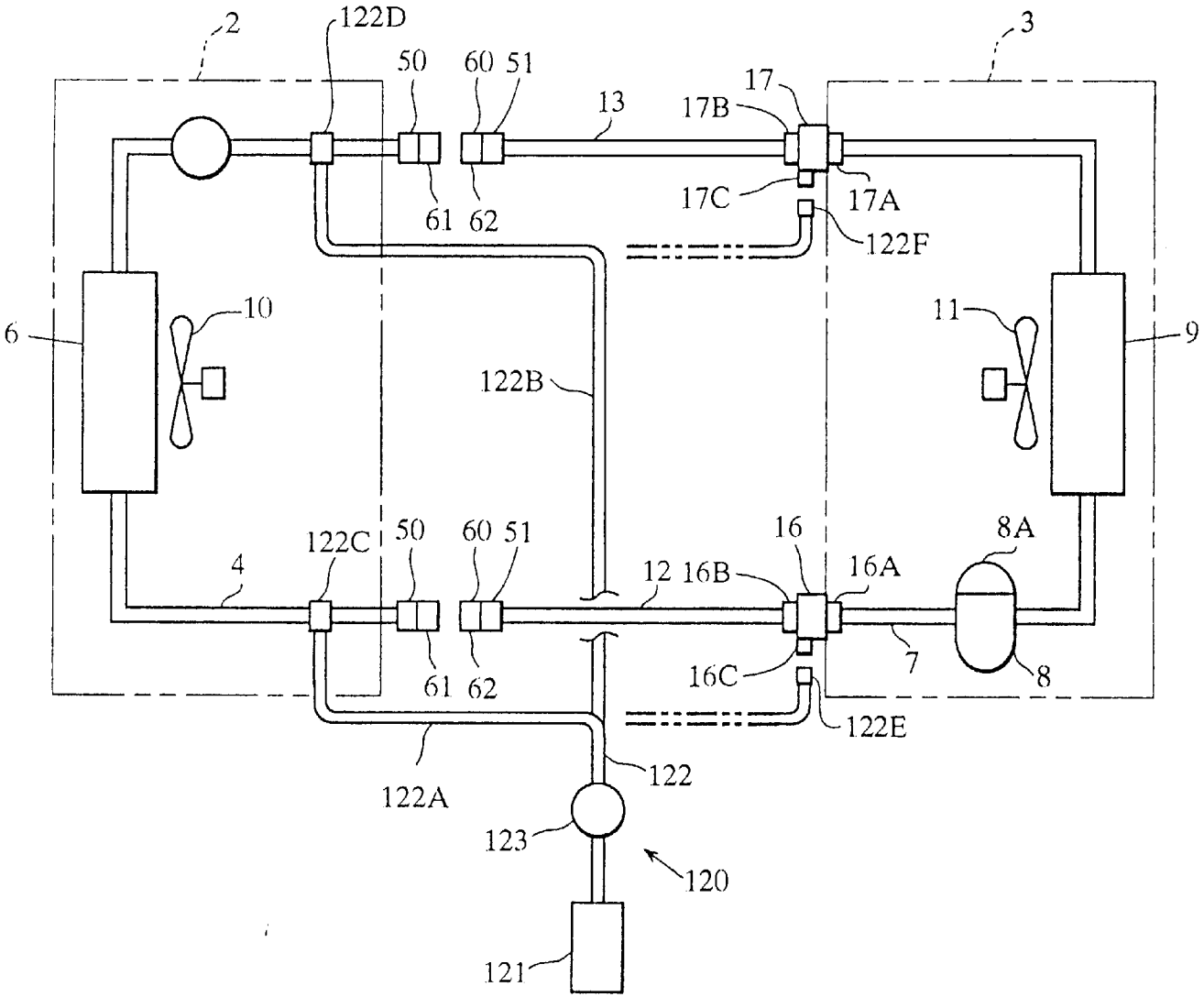
FIG. 18 is a schematic view in recovering refrigerant from an air conditioner provided with the on-off valves shown in FIG. 9 and FIG. 11.

When a used refrigerant is recovered at a refrigerant recovery site because the air conditioner is disposed of, a refrigerant recovery instrument 120 shown in FIG. 18 is used after the first connection member 61 and the second connection member 62 of the on-off valve 60 are detached and the air conditioner is brought to the refrigerant recovery site. The instrument 120 has a recovery vessel 121 such as a cylinder, a recovery pipe 122 extended from the recovery vessel 121, and a suction instrument 123 such as a suction pump provided to the recovery pipe 122 which is branched at some midpoint into branch pipes 122A and 122B. At the forward ends of the branch pipes 122A, 122B, connecting sockets 122C, 122D are provided. The connecting sockets 122C, 122D are of well known parts, which are detachably and tightly related to the refrigerant piping 4, to suck up the refrigerant remained in the refrigerant piping 4 by inserting plugs thereof into corresponding sockets provided on the piping 4. The refrigerant remained in the first refrigerant piping 4 is sucked by a suction instrument 123 from the connecting sockets 122C, 122D through the recovery pipe 122 and is finally recovered to the vessel 121.

After completing the recovery of the refrigerant from the first refrigerant piping 4, the connecting sockets 122C, 122D are exchanged with other connecting sockets 122E, 122F which are connectable to the connecting ports 16C, 17C of the on-off valves 16, 17, and the connecting sockets 122E, 122F are connected to the connecting ports 16C, 17C. The valve element 20 shown in FIG. 2 of the on-off valve 16, 17 is moved to the middle position of advanced limit and retreat limit, and the refrigerant recovery work for the refrigerant in the second refrigerant piping 7 and the connection pipes 12, 13 is carried out, either when the on-off valves 16, 17 are shut (when the connecting pipes 12, 13 are dismantled and the connecting ports 16B, 17B are sealed with the seal members 24 and the nuts 23) or when the on-off valves 16, 17 are opened (when the connecting pipes 12, 13 are mounted)

Incidentally, when the connecting pipes 12, 13 are connected to the on-off valves 16, 17, the branch pipes 122A, 122B are kept on with the connecting sockets 122C, 122D, the refrigerant recovery from the exterior instrument 3 can be carried through joining the connecting sockets 122C, 122D to the connecting pipes 12, 13.

When an air conditioner in which the on-off valves 90, 100, 110 from FIG. 12 to FIG. 17 are provided at the connecting points of the first refrigerant piping 4 with the connecting pipes 12, 13, is transferred to a new place because of expiration of a leased or a rented contract or is disposed of because of wear and tear, the continuous channel is closed by means of the valve elements 97, 104, 115, and the on-off valves 16, 17 are closed as well. The female screws 51 of the connecting pipes 12, 13 are dismantled from the second end portions 94, 102, 112 of the on-off valves 90, 100, 110, then the connecting pipes 12, 13 are released from the on-off valves 16, 17. Through above described process, the refrigerant in the first refrigerant piping 4 and the refrigerant in the second refrigerant piping 7 are sealed in.

The rest processes at a new place or at a refrigerant recovery site after the processes described above is the same as that the on-off valve 60 from FIG. 9 to FIG. 11 is arranged at the connecting point of the first refrigerant piping 4 with the connecting pipes 12, 13 and the connecting pipes 12, 13 are removed from the on-off valves 16, 17. Thus, at the new place, after the connecting pipes 12, 13 are connected to the on-off valves 16, 17, the female screws 51 of the connecting pipes 12, 13 are connected to the second end portion 94, 102, 112 of the on-off valves 90, 100, 110, and after the connecting sockets of an air charging system and of a refrigerant supply instrument are connected in turn to the connecting ports 16C and 17C of the on-off valves 16, 17 so that the shortage of the refrigerant is supplied to the connecting pipes 12, 13. Then the on-off valves 16, 17 and the on-off valves 90, 100, 110 are opened. And at a refrigerant recovery site, the refrigerant remained in the first refrigerant piping 4 are recovered through the connecting sockets 122C, 122D of the refrigerant recovery instrument 120, and the refrigerant remained in the second refrigerant piping 7 are recovered through the connecting sockets 122E and 122F of the refrigerant recovery instrument 120, respectively.

Figure 19:
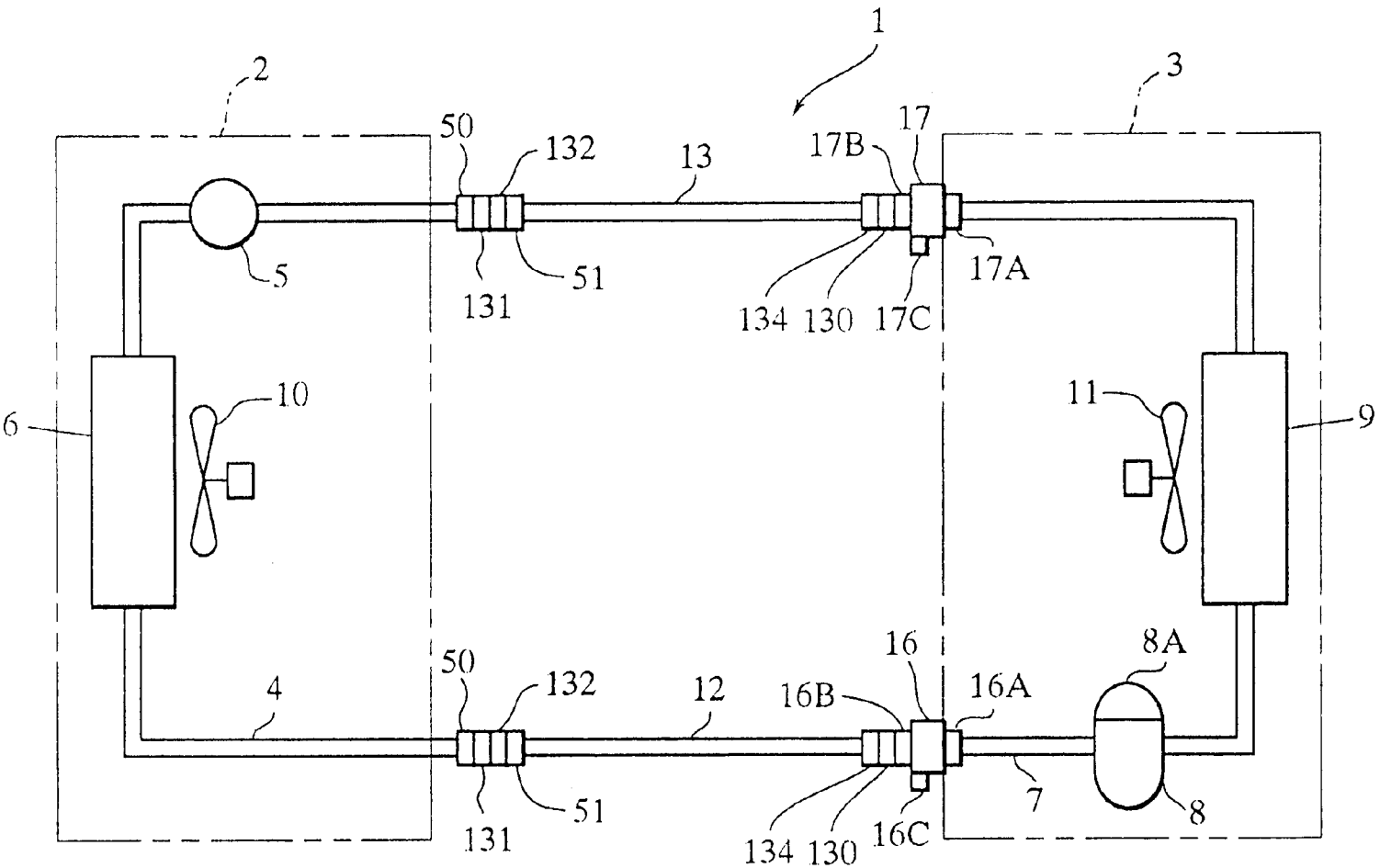
FIG. 19 is a diagrammatic view of a circuit of the air conditioner relating to the third embodiment.
Figure 20:
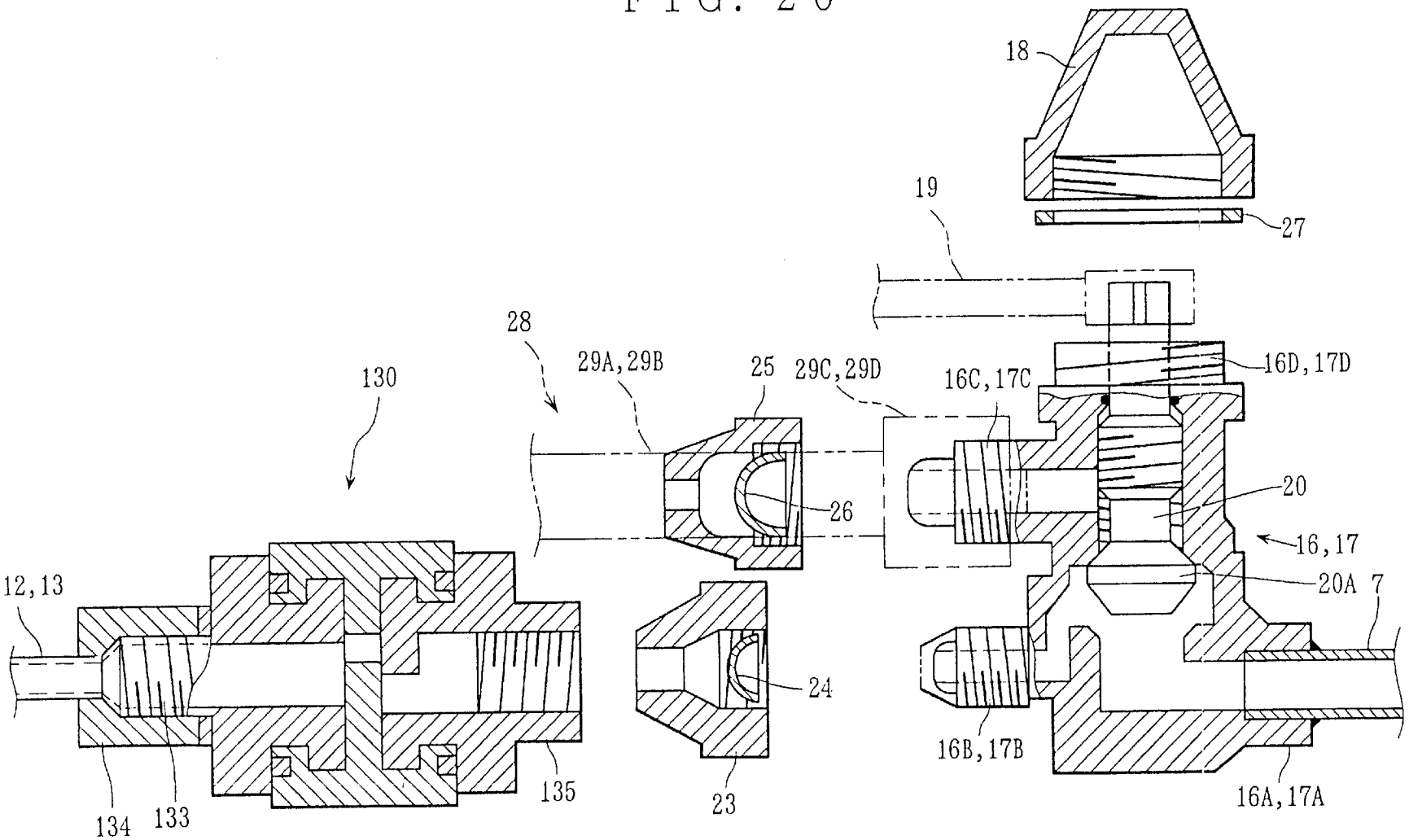
FIG. 20 is a sectional view of an on-off valve provided in the refrigerant piping of the exterior instrument in FIG. 19 and another on-off valve provided in the connecting pipe to be connected to the on-off valve.
Figure 21:
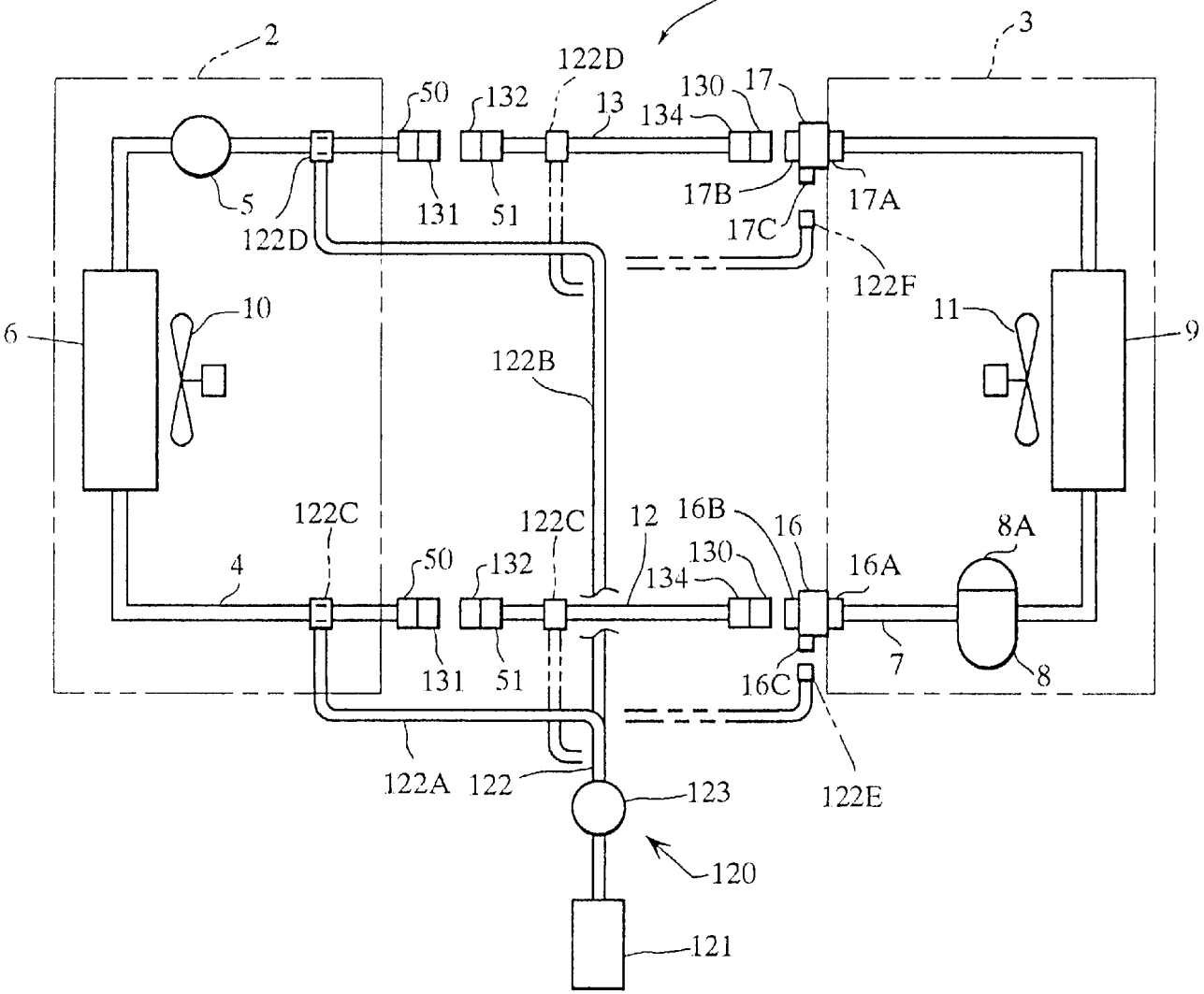
FIG. 21 is a schematic view of a work in recovering refrigerant from the air conditioner in FIG. 19 at a refrigerant recovery site.

The third embodiment is shown From FIG. 19 to FIG. 21. According to the embodiment the on-off valves 16, 17 provided at the both ends of the second refrigerant piping 7 are a first on-off valves. A second on-off valves 130 which are connected in a detachable manner with the first on-off valves 16, 17, are provided at the ends of the connecting pipes 12, 13 on the side of the second refrigerant piping 7, a third on-off valves 131 are provided at the both ends of the first refrigerant piping 4 and a fourth on-off valves 132 which are connected in a detachable manner with the third on-off valves, are provided at the ends of the connecting pipes 12, 13 on the side of the first refrigerant piping 4.

FIG. 20 shows the first on-off valves 16, 17 and the second on-off valve 130 in a detached state. The second on-off valve 130 shown in FIG. 20 is the same type as the on-off valve 90 shown in FIG. 12 and FIG. 13. A first end portion 133 which is a male screw, is connected with a female screw 134 which is provided in a rotatable manner at the end of the connecting pipes 12, 13 on the side of the second refrigerant piping 7 and a second end portion 135 which is a female screw, is connected with the connecting ports 16B, 17B of the first on-off valves 16, 17 from where the seal member 24 and the nuts 23 are removed. The third on-off valve 131 and the fourth on-off valve 132 in the present embodiment are the first connection member 61 and the second connection member 62 of the on-off valve 60 shown from FIG. 9 to FIG. 11. Thus, the connection member 61, 62 individually have the valve elements 67, 68 and can be an on-off valve.

Incidentally, the second on-off valve 130 may be the on-off valve 100 shown in FIG. 14 and FIG. 15 or the on-off valve 110 shown in FIG. 16 and FIG. 17. And the third on-off valve 131 and the fourth on-off valve 132 may be the on-off valve 90 shown in FIG. 12 and FIG. 13 or may be the on-off valve 100 shown in FIG. 14 and FIG. 15 or may be two pieces of the on-off valve 110 shown in FIG. 16 and FIG. 17 connected in series.

When a leased or a rented air conditioner 1 is transferred to a new place because of expiration of the contract, all on-off valves 16, 17, 130, 131, 132 are closed and the first on-off valves 16, 17 are separated from the second on-off valve 130, and the third on-off valve 131 is separated from the fourth valve 132. (In the present embodiment, as the third on-off valve 131 and the fourth on-off valve 132 are the first connection member 61 and the second connection member 62 of the on-off valve 60, the closing and separating of the on-off valve 131 and 132, is performed by closing and separating the first connection member 61 from the second connection member 62) Thus, the connecting pipes 12, 13 are removed from the first refrigerant piping 4 and the second refrigerant piping 7, the refrigerant remained in the first refrigerant piping 4, the refrigerant remained in the second refrigerant piping 7 and in the connecting pipes 12, 13 are sealed in, respectively.

Then, the air conditioner 1 is transferred to the new place and the interior instrument 2 and the exterior instrument 3 are installed at appropriate position, the first on-off valves 16, 17 are connected to the second on-off valve 130, the third on-off valve 131 is connected to the fourth on-off valve 132. Thus, the connecting pipes 16, 17 are connected to the first refrigerant piping 4 and the second refrigerant piping 7, and all on-off valves 16, 17, 130, 131 and 132 are opened. The refrigerant circulating channel through which the refrigerant circulates in the whole air conditioner 1 is formed again. Thus the air conditioner is ready to use at the new place with all refrigerant used at the prior place.

Incidentally, when leakage of the refrigerant in the connecting pipes 16 or 17 is found after transfer to a new place, the connecting ports 16C, 17C of the on-off valves 16, 17 in FIG. 20 are connected with the connecting sockets 29C, 29D of a refrigerant supply instrument 28 and through being positioned the valve element 20 at the midst of advance limit and retreat limit, the shortage of the refrigerant can be supplied from the refrigerant supply instrument.

When the air conditioner 1 is disposed of because of wear and tear, the process are the same as in the case of moving to a new place, that is; all on-off valves 16, 17, 130, 131 132 are closed and the first on-off valves 16, 17 are separated from the second on-off valve 130, and the third on-off valve 131 is separated from the fourth on-off valve 132, thus the connecting pipes 12, 13 are removed from the first refrigerant piping 4 and the second refrigerant piping 7, the refrigerant remained in the first refrigerant piping 4, in the second refrigerant piping 7 and in the connecting pipes 12,13 are sealed in, respectively.

Then, the interior instrument 2, the exterior instrument 3 and the connecting pipes 12, 13 are carried to a refrigerant recovery site, the connecting sockets 122C and 122D of the recovery pipe 122 of the refrigerant recovery instrument 120 are connected to the first refrigerant piping 4, the connecting pipes 12, 13, and the connecting sockets 122E, 122F are connected to the connecting ports 16C, 17C of the on-off valves 16, 17. Thus the refrigerant remained in the first refrigerant piping 4, in the connecting pipes 12, 13 and in the second refrigerant piping 7, in other words, all the refrigerant remained in the air conditioner 1, is recovered into the recovery vessel 121.

Figure 22:
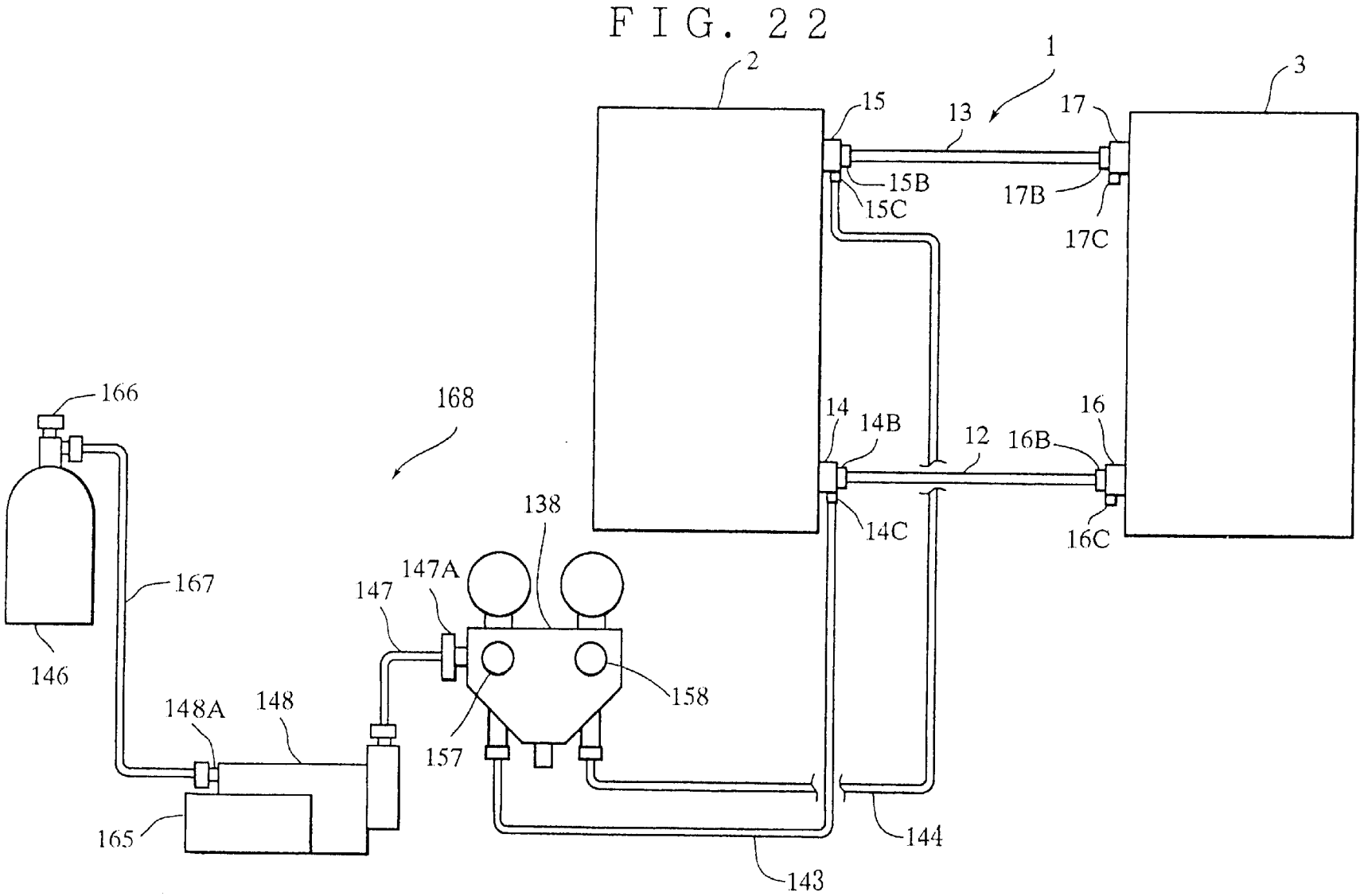
FIG. 22 is a schematic view of a work in recovering refrigerant from the connecting pipes of the air conditioner relating to the fourth embodiment.
Figure 23:
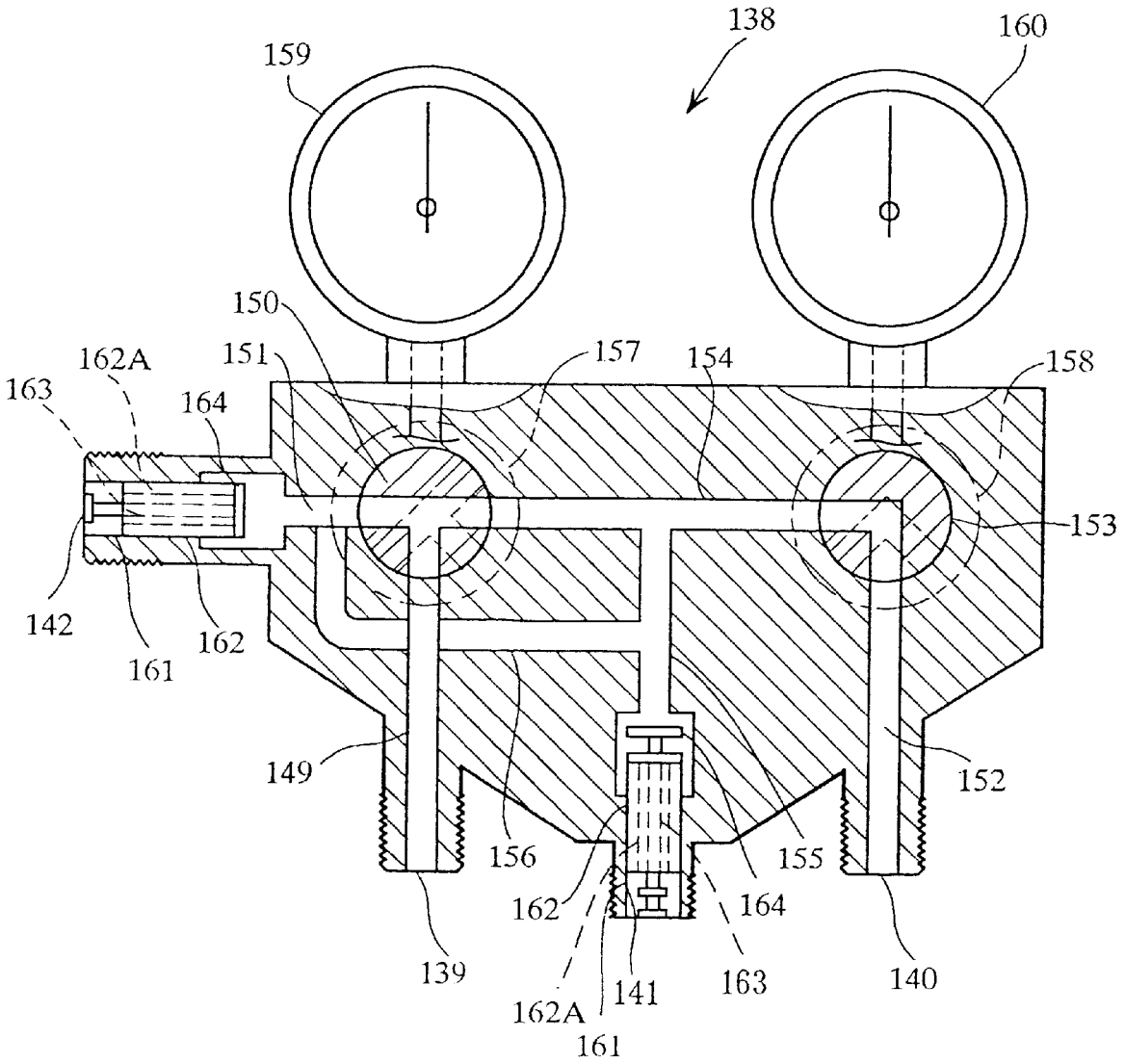
FIG. 23 is a sectional view of the manifold shown in FIG. 22.
Figure 24:
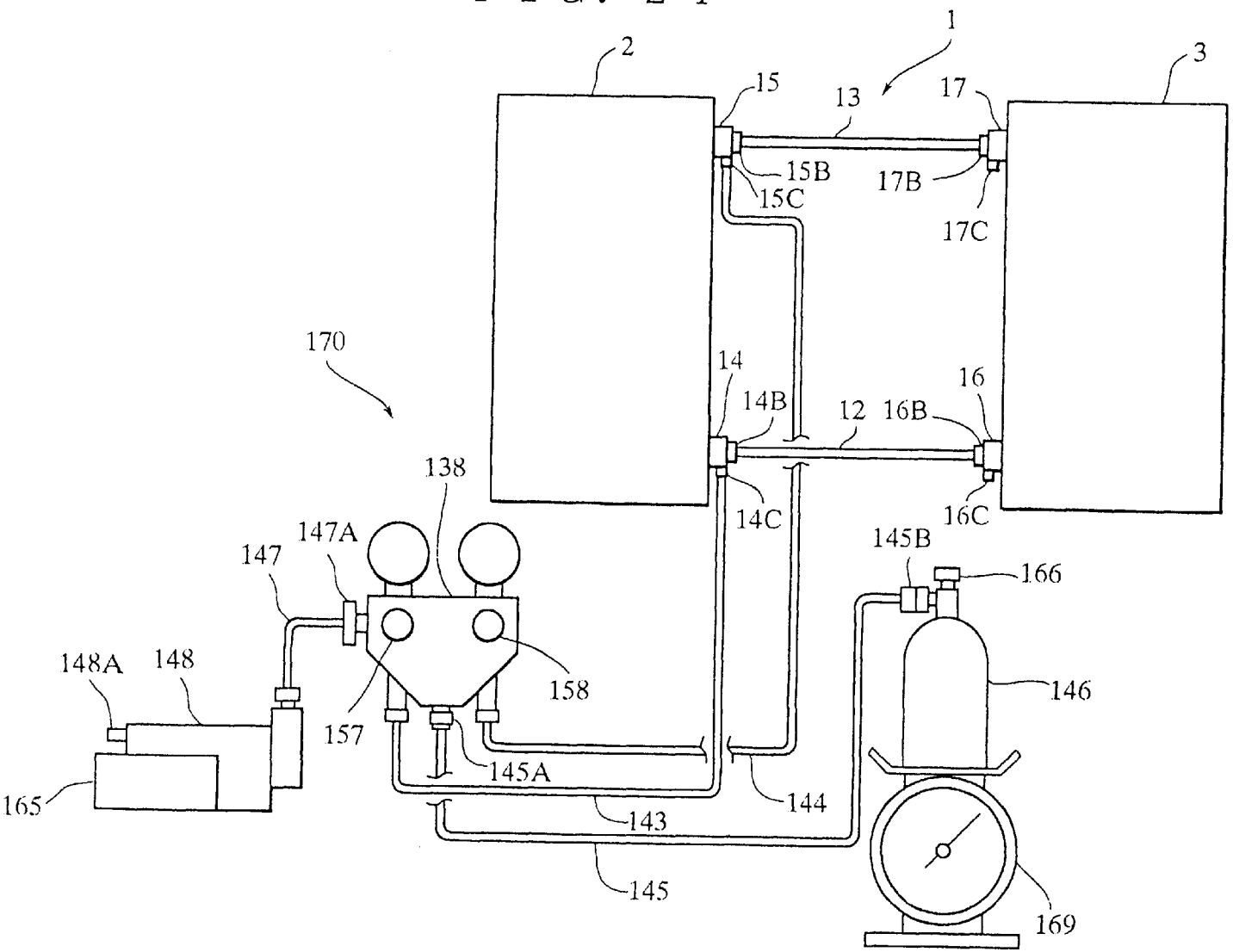
FIG. 24 is a schematic view of a work in supplying refrigerant into the connecting pipes after transfer of the air conditioner shown in FIG. 22 to a new place.

The fourth embodiment is shown from FIG. 22 to FIG. 24. The on-off valves 14, 15 in the first refrigerant piping 4 are arranged at the connecting point with the connecting pipes 12, 13, while the on-off valves 16, 17 in the second refrigerant piping are arranged at the connecting point with the connecting pipes 12, 13.

FIG. 22 shows a refrigerant recovery instrument 168, and FIG. 23 shows the manifold 138 which is a constituent member of the refrigerant recovery instrument 168 and also a member of a refrigerant supply instrument 170 shown in FIG. 24. The manifold 138 has four ports from a first to a fourth port 139–142. As shown in FIG. 22, the first port 139 is joined to the connecting port 14C of the on-off valve 14 through a hose 143 and the second port 140 is joined to the connecting port 15C of the on-off valve 15 through a hose 144. The third port 141 is joined to a cylinder 146 through a hose 145 provided with an on-off valve 145B as shown in FIG. 24 and the fourth port 142 is joined to a vacuum pump or a suction instrument 148 through a hose 147 as shown in FIG. 22 and FIG. 24.

As shown in FIG. 23, the first port 139 is related to the fourth port 142 through a channel 149, a rotary valve 150 and a channel 151. The second port 140 is related to the fourth port 142 through a channel 152, a rotary valve 153, a channel 154, the rotary valve 150, and the channel 151. The third port 141 is related to the fourth port 32 through a channel 155, 156, 151 and also connected to the channel 154 through the channel 155. The rotary valves 150, 153 are driven by a rotational controller 157, 158 exposed outside the manifold 138 (refer to FIGS. 22, 24). In response to the rotation of the rotary valve 150, the stream flowing through the channels between 149, 151, 154 is opened or closed while in response to the rotation of the rotary valve 153, the stream of the two channels between 152 and 154 is opened or closed.

The manifold 138 is provided with two pressure gages 159, 160. The first and the second ports 139, 140 are connected to the connecting ports 14C, 15C of the on-off valves 14, 15 through the hoses 143, 144. When the stream between three channels 149, 151, 154 and the stream between two channels 152, 154 are respectively shut by means of the rotary valves 150, 153, the internal pressure of the connecting pipes 12, 13 can be detected by means of the pressure gages 159, 160 relating to the ports 139, 140.

Valve cores 161 are integrated inside the third port 141 and the fourth port 142. The valve core 161 has a main core body 162, an axle 163 inserted into a through hole 162A on the center of the main core body 162 and a plate member 164 which is fixed on the end surface of the axle 163 in the inner portion of the port. The plate member 164, which is not shown, is an elastic solid and is usually touched on the end surface of the main core body 162 in the inner portion of the port so that the valve cores 161 are closed (the third port 141 and the fourth port 142 are closed) and the refrigerant can not flow. When the third port 141 and the fourth port 142 are connected with connecting elements 145A, 147A at the ends of the hoses 145, 147, the valve core 161 is opened and the refrigerant can flow. Because core pushing elements or projections are provided inside the connecting elements 145A and 147A The pushing elements push, the axles 163 of the valve cores 161 into the inner portion of the ports opposing against the push back of the elastic solid, and detach the plate members 164 from the inner side surfaces of the main core bodies 162 to open the valve cores 161 so that the refrigerant can flow inside.

As shown in FIG. 22 and in FIG. 24, the vacuum pump 148 has a self-driving device 165 operated by means of such as a gasoline engine so that the vacuum pump 148 can be operated even when electricity is suspended into the building in which the air conditioner 1 is installed. The vacuum pump 148 has an outlet 148A. When liquid inside the connecting pipes 12, 13 is sucked through the hoses 143, 144 by means of the vacuum pump 148, the liquid is discharged through the outlet 148A to outside the vacuum pump 148. The cylinder 146 has a cock 166. A valve inside the cylinder is opened or shut by rotating the cock 166 so that the flow of refrigerant into or from the cylinder 146 can be controlled.

When an air conditioner 1 is leased or rented and is transferred to a new place because of expiration of the contract, or a tear or wear air conditioner 1 is carried to a refrigerant recovery site to dispose of the air conditioner, all on-off valves from 14 to 17 are closed. Then, the first port 139 and the second port 140 of the manifold 138 are connected to the connecting port 14C of the on-off valve 14 and the connecting port 15C of the on-off valve 15 through the hoses 143, 144 as shown in FIG. 22. The vacuum pump 148 is connected to the fourth port 142 of the manifold 138 through the hose 147 and the cylinder 36 is connected to the outlet 148A of the vacuum pump 148 through a hose 167. The stream between the three channels 149, 151, 154 and the stream between the two channels 152, 154 are flowed through by means of the rotary valves 150, 153. The inside valve of the cylinder 146 is opened by operating the cock 166 so that the vacuum pump 148 is started to drive. At this moment, as the valve element 20 shown in FIG. 2 in the on-off valve 14–17 reaches to the position of the advance limit, the connecting ports 14B, 15B of the on-off 14, 15 to which the connecting pipes 12, 13 are joined, are connected through with the connecting ports 14C, 15C of the on-off valves 14, 15 to which the hoses 143, 144 are joined. Accordingly, the refrigerant in the connecting pipes 12, 13 is recovered through the manifold 138 and the vacuum pump 148 into the cylinder 146.

At this moment as the third port 141 of the manifold 138 is closed because the plate member 164 is touched on the side surface of the main core body 162 in inner portion of the port, there can be no leakage of the refrigerant from the port 141.

Incidentally, when the vacuum pump is started to drive, the outlet 148A is kept unconnected with the hose 167 so that air inside the hoses 143, 144, the manifold 138, the hose 147, and the vacuum pump 148 are ejected at first. After being made certain that the refrigerant begins to flow out from the outlet 148A, the hose 167 is connected to the outlet 148A.

As has been described above, the refrigerant in the connecting pipes 12, 13 is recovered in the cylinder 146 while the refrigerant in the first refrigerant piping 4 and the second refrigerant piping 7 is being kept sealed in. Consequently, the hoses 143, 144, the manifold 138, the hose 147, the vacuum pump 148, the hose 167, the cylinder 146 are served as a refrigerant recovery instrument 168 to recover the refrigerant from the connecting pipes 12, 13. After the refrigerant remained in the connecting pipes 12, 13 is recovered, the valve inside the cylinder 146 is closed by means of the cock 166.

After the refrigerant remained in the connecting pipes 12, 13 is recovered into the refrigerant recovery instrument 168, the connecting pipes 12, 13 are dismantled from the connecting ports 14B, 15B, 16B, 17B of the on-off valves 14–17. The refrigerant recovery instrument 168 is removed from the connecting ports 14C, 15C of the on-off valves 14, 15 and the connecting ports 14B, 14C, 15B, 15C, 16B, 17B are sealed with the seal members 24, 26 fixed by the nuts 23, 25. The screw barrel members 14D, 15D are tightly coupled with the screw of the cap 18 through the packing 27. Then, transfer of the interior instrument 2 and the exterior instrument 3 to a new place, or transfer of a wear and tear air conditioner 1 to a refrigerant recovery site is succeeded. As described above, the work can be completely carried out without any release of the refrigerant into the air from the connecting pipes 12, 13.

The on-off vales 16, 17 provided in the second refrigerant piping 7 at the end of the connecting pipes 12, 13 also have the connecting ports 16C, 17C which can be connected with the refrigerant recovery instrument 168. Accordingly, in the case that the refrigerant recovery instrument 168 can not be reached to the connecting ports 14C, 15C of the on-off valves 14, 15 in accordance with situations of a building where the air conditioner 1 or the interior instrument 2 is installed, the refrigerant recovery instrument 168 can be connected with the connecting ports 16C, 17C of the on-off valves 16, 17 to complete the recovery process.

The recovery of the refrigerant remained in the first refrigerant piping 4 and the second refrigerant piping 7 at a refrigerant recovery site will be explained. At the refrigerant recovery site where the interior instrument 2 and the exterior instrument 3 are brought, the connecting sockets 122C, 122D of the refrigerant recovery instrument 120 shown in FIG. 18 which are provided with needle elements to stick into the first refrigerant piping 4 and the second refrigerant piping 7, and the connecting sockets 122E, 122F which are connected to the connecting ports 14C, 15C, 16C, 17C of the on-off valves 14–17, are used to recover the refrigerant remained in the first refrigerant piping 4 and the second refrigerant piping 7. Then the air conditioner 1 is disposed of.

Incidentally, though the refrigerant in the first refrigerant piping 1 and the refrigerant in the second refrigerant piping 7 including the refrigerant in the connecting pipes 12, 13 can be recovered using the refrigerant recovery instrument 168 in a state of the on-off valves 14–17 open in the building before the air conditioner 1 is brought to a refrigerant recovery site, but it takes long time for the recovery, so it is preferable to carry out the work as above described, it is preferable to carry out the work.

After an air conditioner 1 with a lease or a rent contract is transferred to a new place and the interior instrument 2 and the exterior instrument 3 are installed at appropriate place, the connecting pipes 12, 13 are connected to the connecting ports 14B, 15B, 16B, 17B of the on-off valves 14 to 17, and the first port 139, the second port 140 of the manifold 138 are connected to the connecting ports 14C, 15C of the on-off valves 14, 15 through the hoses 143, 144 as shown in FIG. 24. In the case that the hoses 143, 144 can not be reached to the connecting ports 14C, 15C of the on-off valves 14, 15 in accordance with situation for the installation of the interior instrument 2, same as in the case above described, the hoses 143, 144 can be connected to the connecting ports 16C, 17C of the on-off valves 16, 17.

The vacuum pump 148 is joined with the fourth port 142 of the manifold 138 through the hose 147, and the cylinder 146 which is connected to the outlet 148A of the vacuum pump 148 is joined with the third port 141 of the manifold 138 through the hose 145 provided with the on-off valve 145B. The cylinder 146 is placed on a weighing instrument 169.

Then the vacuum pump 148 is started to drive. As the on-off valves 14–17 the on-off valve 145B of the hose 145 and the inside valve of the cylinder 146 are closed at this moment, when driving the vacuum pump 148, air inside the connecting pipes 12, 13, the hoses 143, 144, the manifold 138 and the hose 145 are ejected through the outlet 148A of the vacuum pump 148. Then the hose 147 is removed from the fourth port 142 of the manifold 138 so that the port 142 can be closed by means of the valve core 161. The inside valve of the cylinder 146 is opened by means of the cock 166 and the on-off valve 145B of the hose 145 is also opened. Consequently, a pressurized refrigerant in the cylinder 146 is flowed into the connecting pipes 12, 13 inside where is negatively pressurized because of the air emission. The amount of the refrigerant flowed in is always checked in response to a stroke of a pointer of the weighing instrument 169 on which the cylinder 146 is placed, and when the inflow is reached to a designated amount in accordance with the total inside volume of the connecting pipes 12, 13, the hoses 143, 144 and others, the inside valve of the cylinder 146 is closed by means of the cock 166.

Thus, at the new place for the air conditioner 1, after the air inside the connecting pipes 12, 13 is ejected, the required amount of the refrigerant can be again supplied. Accordingly, the hoses 143, 144, the manifold 138, the hose 147, the vacuum pump 148, the hose 145, the cylinder 146 and the weighing instrument 169 are constituents for the refrigerant supply instrument 170 which ejects air inside the connecting pipes 12, 13 first and then supplies the refrigerant.

As has been described above, after the inside valve of the cylinder 146 is closed by means of the cock 166, the on-off valves 14 to 17 are opened. In other words, the valve elements 20 of the on-off valves 14–17 are retreated by means of the tool 19 until the retreat limit, the heads 20A are touched to the valve seats 22. Thus the refrigerant circulating channel in which the refrigerant circulates in the whole air conditioner 1 is formed again.

Then the on-off valve 145B of the hose 145 is closed and the cylinder 146 is removed from the end portion of the hose 145. As shown in FIG. 22, the cylinder 146 is joined with the outlet 148A of the vacuum pump 148 through the hose 167 and the vacuum pump 148 is joined with the fourth port 142 of the manifold 138 through the hose 147. Then after the inside valve of the cylinder 146 is opened by the cock 166, the vacuum pump 148 is started to drive. Consequently, the refrigerant remained in the hoses 143, 144, the manifold 142, the hose 145 is returned to the cylinder 146. At this time, as the continuous channel between the connecting ports 14C, 15C of the on-off valves 14, 15 and the connecting ports 14A, 15A, 14B, 15B is closed by means of the valve element 20, the refrigerant remained in the connecting pipes 12, 13 can not flow into the cylinder 146.

It is preferable not to recover all the refrigerant remained in each hoses 143, 144, 145 at a time. The refrigerant in the hose 145 is recovered at first. Then the refrigerant remained inside the hose 143, 144 is recovered. To recover the refrigerant in turn, streams between the three channels 149, 151, 154 of the manifold 138 and between the two channels 152, 154 are first closed by means of the rotary valves 150, 153 so that the refrigerant remained in the hose 145 is recovered into the cylinder 146 through the channel 156 of the manifold 138, then the streams between each channel are opened by means of the rotary valves 150, 153 so that the refrigerant remained in the hoses 143, 144 can be recovered. Thus the step by step recovery of the refrigerant does not require a big power for driving the vacuum pump.

Then the hose 143, 144 are removed from the connecting ports 14C, 15C of the on-off valves 14, 15 and the connecting ports 14C, 15C are sealed with the seal member 26 fixed with the nut 25. Thus, the air conditioner can be driven at the new place.

Incidentally, when the refrigerant is supplied from the cylinder 146 of the refrigerant supply instrument 170 shown in FIG. 24 to the connecting ports 12, 13, the supply work can be carried out in a state that the on-off valves 14–17 are kept open, that is, the valve elements 20 of the on-off valves 14–17 is positioned at the midpoint of advance limit and retreat limit. When the refrigerant supply is carried out in such state that the on-off valves 14–17 are kept open, the first refrigerant piping 4, the second refrigerant piping 7 and the connecting pipes 12, 13 are connected to each other so that the refrigerant circulating channel are formed, either one of the stream between the three channels 149, 151, 154 or the stream between the two channels 152, 154, is closed by means of closing either one of the rotary valves 150 or 153. Thus only one of the hose 143 or the hose 144 can be used (in such case, one of the connecting port 14C or 15C of the on-off valve 14 or 15 to which the hose 143 or 144 is not connected is sealed with the seal member 26 fixed with the nut 25).

When the refrigerant in the cylinder 146 is supplied to the air conditioner through the manifold 138, it is also available that, without using the weighing instrument, the refrigerant in the cylinder 146 are replaced into another cylinder which is not shown in a figure and the cylinder is connected to the manifold 138 using the hose 145 so that the refrigerant in the cylinder can be supplied to the air conditioner through the manifold 138. When an equivalent amount of the refrigerant to match with the inside volume of the connecting pipes 12, 13 is found to have been supplied into the air conditioner 1 by checking a scale provided on the outer surface of the cylinder, the on-off valve is closed.

In such a case that the refrigerant circulating channel is formed and the refrigerant is supplied from the cylinder 146 of the refrigerant supply instrument 170 or from the above described cylinder into the air conditioner 1 while the air conditioner 1 is being driven and a sensor to detect the refrigerant pressure inside the refrigerant circulating channel is provided in the refrigerant circulating channel, the refrigerant supply from the cylinder 146 or from the above described cylinder can be carried out with checking the refrigerant pressure detected by the sensor. Incidentally, the pressure is shown from the Mollier chart, in which the ordinate axis expresses a pressure while the abscissa axis expresses an enthalpy. When the refrigerant pressure inside the refrigerant circulating channel is risen to the pressure in accordance with the outside-air temperature, the refrigerant supply from the cylinder 146 or from the cylinder can be stopped.

The above described process has advantages that the weighing instrument can be omitted and if there is any leakage of the refrigerant from the first refrigerant piping 4 or the second refrigerant piping 7 while the air conditioner 1 is being carried to a new place, the refrigerant can be exactly supplied including the supplement for the leakage into the refrigerant circulating channel.

Figure 25:
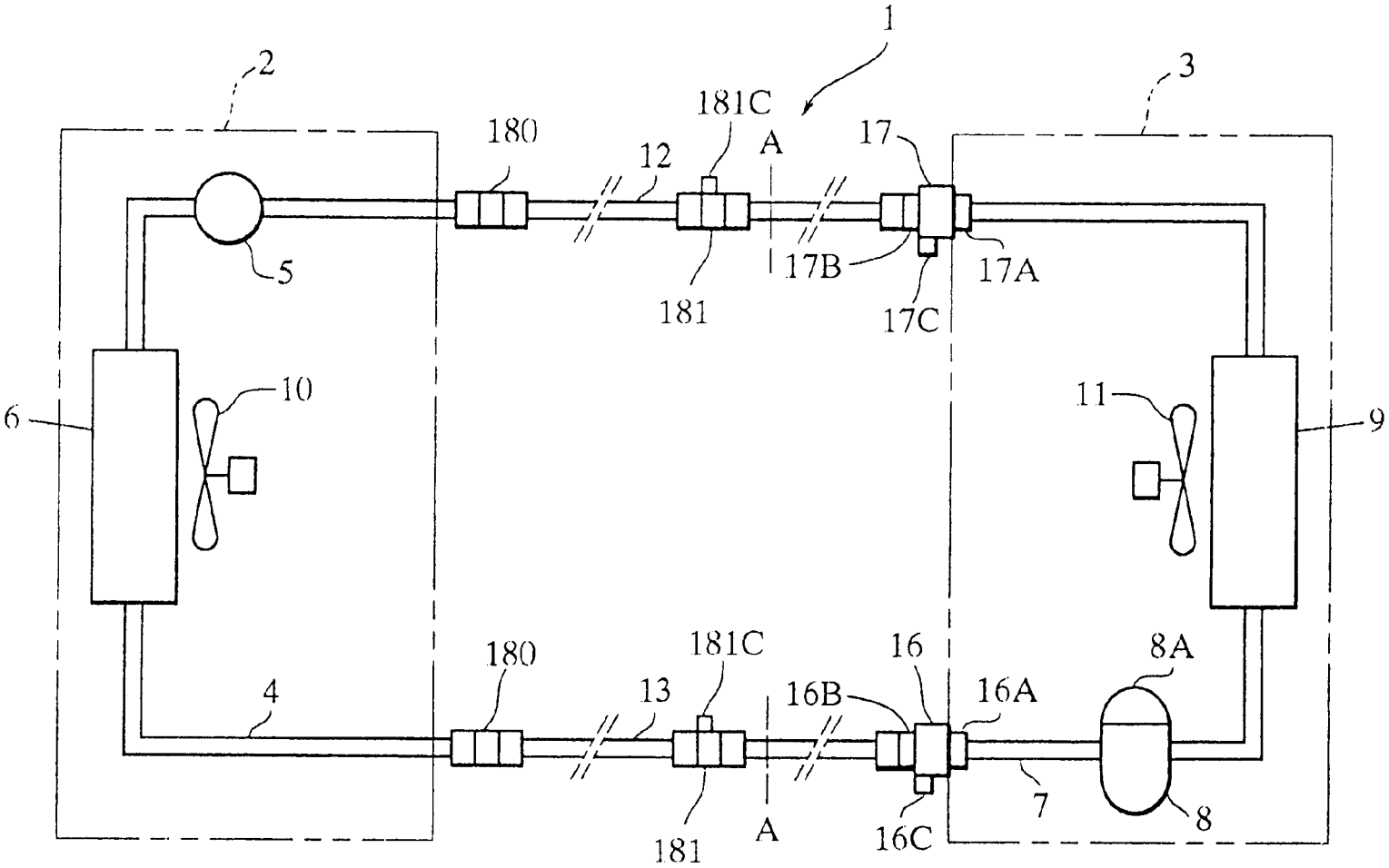
FIG. 25 is a schematic view of a circuit of an air conditioner relating to the fifth embodiment.
Figure 26:
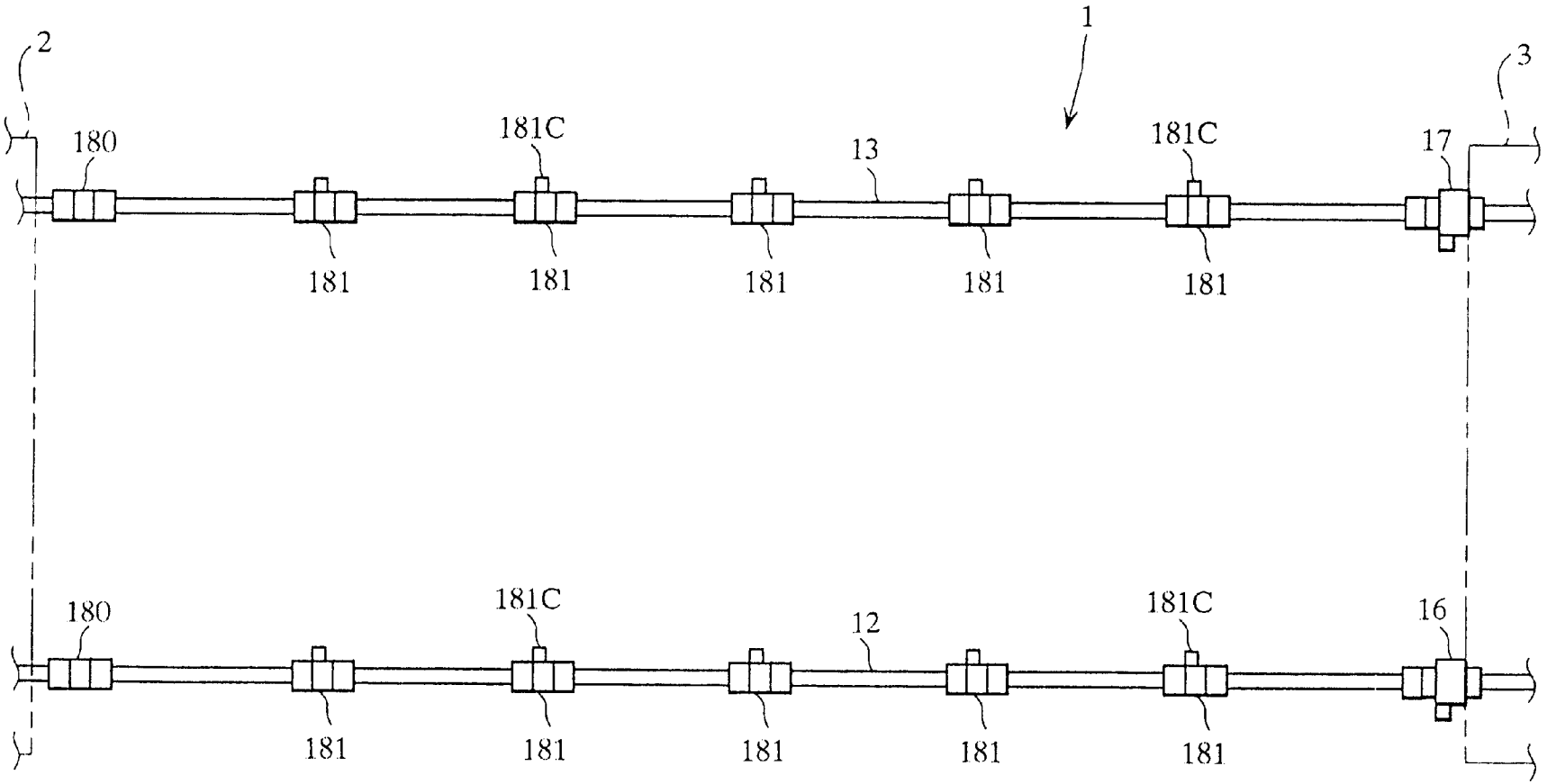
FIG. 26 is a schematic view of the whole connecting pipes, a part of which is omitted in FIG. 25.
Figure 27:
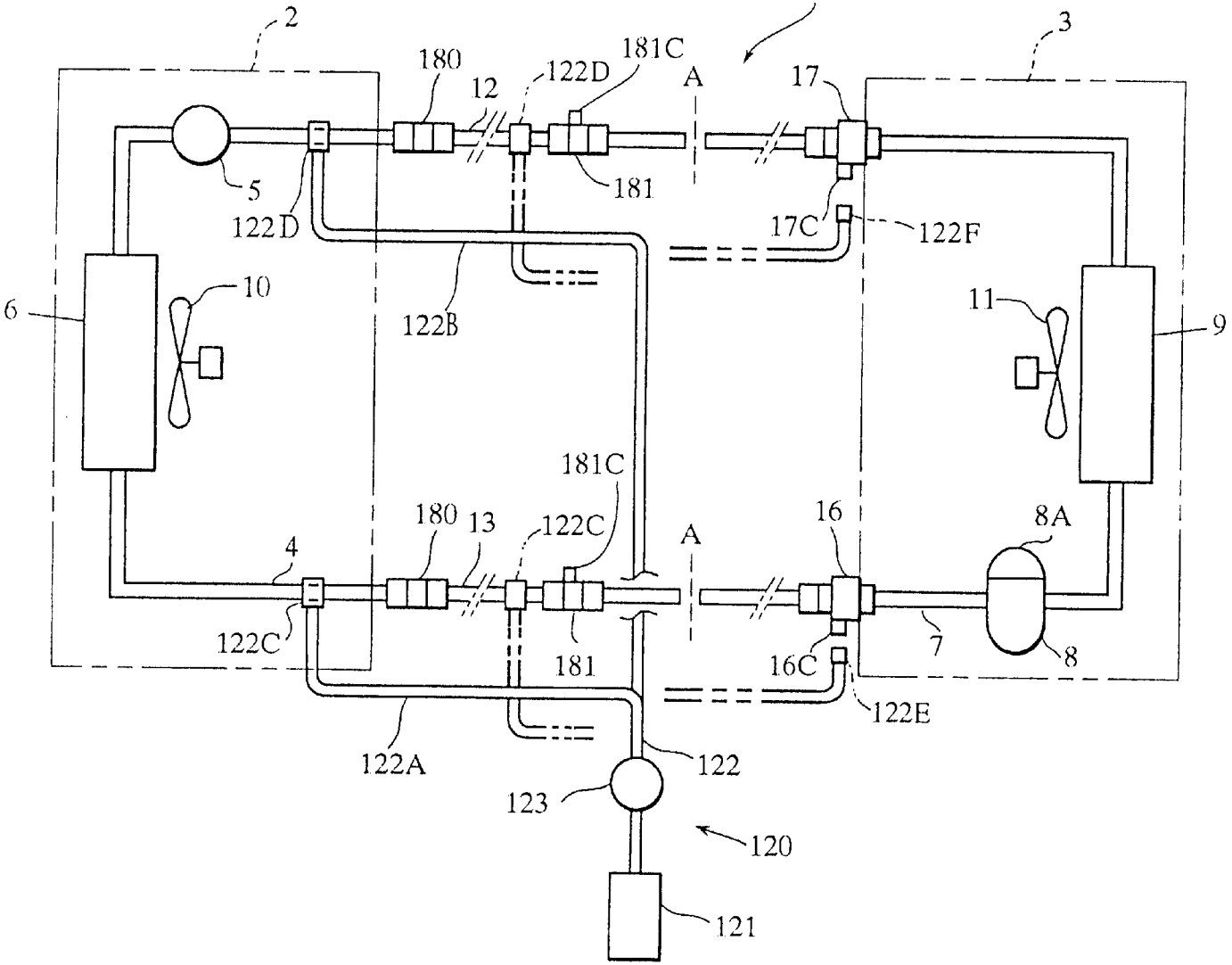
FIG. 27 is a schematic view of a work in recovering refrigerant from the air conditioner in FIG. 25 at a refrigerant recovery site.

The fifth embodiment of the present invention is shown from FIG. 25 to FIG. 27. In the embodiment, as shown in FIG. 25, the on-off valves 16, 17 are provided in the second refrigerant piping 7 at the connecting point with the connecting piping 12, 13, while on-off valves 180 are provided in the refrigerant piping 4 at the connecting point with the connecting pipes 12, 13. And at some midpoint in a longitudinal direction of the connecting pipes 12, 13, an on-off valve 181 is provided. The air conditioner in the embodiment is for building use, so the connecting pipes 12, 13 are long. In the long connecting pipes 12, 13, a plurality of the on-off valves 181 are arranged at predetermined intervals, as shown in FIG. 26.

The on-off valves 180 may be the on-off valve 90 in FIG. 12 and FIG. 13, or may be the on-off valve 100 in the FIG. 14 and FIG. 15, or also may be the on-off valve 110 in FIG. 16 and FIG. 17. The on-off valve 181 has the same structures and functions as those of the on-off valves 14 to 17 in FIG. 2 and has a connecting port 181C which can be coupled with the connecting socket of the refrigerant supply instrument.

When an air conditioner 1 with a lease or a rent contract is carried to a new place, after all the on-off valves 16, 17, 180, 181 are closed, the connecting pipes 12, 13 are cut at some midpoint from the on-off valve 181 to the exterior instrument 3, shown at A on FIG. 25. The cut position is decided depending on a situation in which the air conditioner 1 is installed, and is at some midpoint from the on-off valve 181 disposed at the most suitable position for the cut among plural on-off valves 181 arranged along the longitudinal direction in the connecting pipes 12, 13 toward the exterior instrument 3. The interior instrument 2 and the exterior instrument 3 are separated with each other through the cut of the connecting pipes 12, 13. Then the interior instrument 2 and the exterior instrument 3 can be carried to the new place with the cut connecting pipes 12, 13 kept on connection to the first refrigerant piping 4 and the second refrigerant piping 7. At this time, the refrigerant in the first refrigerant piping 4 is sealed in by the on-off valve 180 and the refrigerant in the second refrigerant piping 7 is sealed in by the on-off valves 16, 17. And within the refrigerant in the connecting pipes 12 and 13, the refrigerant in the pipe between the on-off valve 180 and the on-off valve 181 which is disposed at the nearest position from the cut position A to the interior instrument 2, is also sealed in.

Incidentally, the sealing in of the refrigerant in the connecting pipes 12, 13 may be carried out by closing only one on-off valve 181 which is disposed at the most suitable position for the cut among other plural on-off valves 181 in the connecting pipes 12, 13. Though only one on-off valve 181 may be provided in the connecting pipes 12, 13. But the provision of plural numbers of the on-off valves helps smooth selection of the cut position so that as much as possible amount of the refrigerant can be sealed in, and in case of a partial breakage of the connecting pipes 12, 13, closing of all the on-off valves makes it possible to prevent from escaping all of the refrigerant in the connecting pipes 12, 13.

It is also available to seal in the refrigerant in the first refrigerant piping 4 and the connecting pipes 12, 13 by means of the on-off valve 181, without providing the on-off valve 180 on the first refrigerant piping. But the provision of the on-off valve 180 on the first refrigerant piping 4 helps to prevent from leakage of the refrigerant in the first refrigerant piping 4 in case of breakage of the connecting pipes 12, 13 at some midpoint from the closed on-off valve 181 toward the interior instrument 2. The air conditioner 1 is transferred to a new place and after the interior instrument 2 and the exterior instrument 3 are installed at appropriate place, the ends of the cut connecting pipes 12, 13 are flared and the flared connecting pipes are rejoined by means of connecting members such as nuts and bolts. At this time the distance between the interior instrument and the exterior instrument is longer at the new place than the length at the prior place, an extension pipe is joined between the cut pipes. Inversely the length is too short, the connecting pipes 12, 13 are shortened and rejoined. And the connecting socket of the air suction system and the connecting socket of the refrigerant supply instrument are connected in turn to the connecting port 181C of the on-off valve 181 located near the cut position, as previously explained with the embodiments from FIG. 7 to FIG. 18 and the embodiments from FIG. 19 to FIG. 21 so that the shortage of the refrigerant come from leakage in the air during the cut of the connecting pipes 12, 13 is supplied and the closed on-off valves 16, 17, 180, and 181 are opened. Then, the air conditioner 1 is ready for operation.

When the air conditioner 1 is tear and wear and carried to a refrigerant recovery site to recover the refrigerant before disposal, after the connecting pipes 12, 13 are cut in the same way as in the steps for the relocation, the air conditioner 1 is carried to a refrigerant recovery site. As shown in FIG. 27, the connecting sockets 122C, 122D of the refrigerant recovery instrument 120 are joined with the first refrigerant piping 4, and the connecting pipes 12, 13, the connecting sockets 122E, 122F which is replaced with the connecting sockets 122C, 122D are connected to the connecting ports 16C, 17C of the on-off valves 16, 17. Each refrigerant in the first refrigerant piping 4, the second refrigerant piping 7, the connecting pipes 12, 13 are thus recovered into the recovery vessel 121. Most refrigerant remained in the air conditioner 1 is recovered at the refrigerant recovery site through the above described steps.

Incidentally, the on-off valves provided in the connecting pipes 12, 13 shown from FIG. 25 to FIG. 27 can be the on-off valve 60 shown from FIG. 9 to FIG. 11. As previously described, the on-off valve 60 is formed of the first connection member 61 and the second connection member 62. When the connection members 61, 62 are connected or detached, the continuous channel 65, 66 are coordinately opened or closed through the valve elements 67, 68 which are urged by the spring 71, 72. To separate the connection members 61 and 62 is to cut the connecting pipes 12, 13 and the cutting by the separation of the connection members 61 from 62 allows to cut the connecting pipe without any leakage of the refrigerant.

Figure 28:
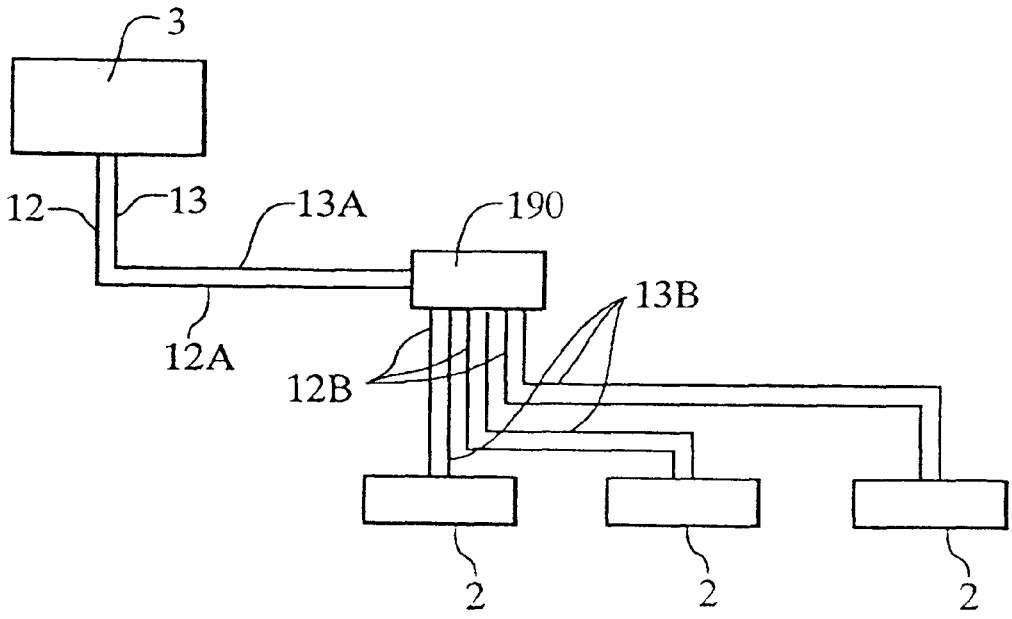
FIG. 28 is a view of a multiple type air conditioner.
Figure 29:
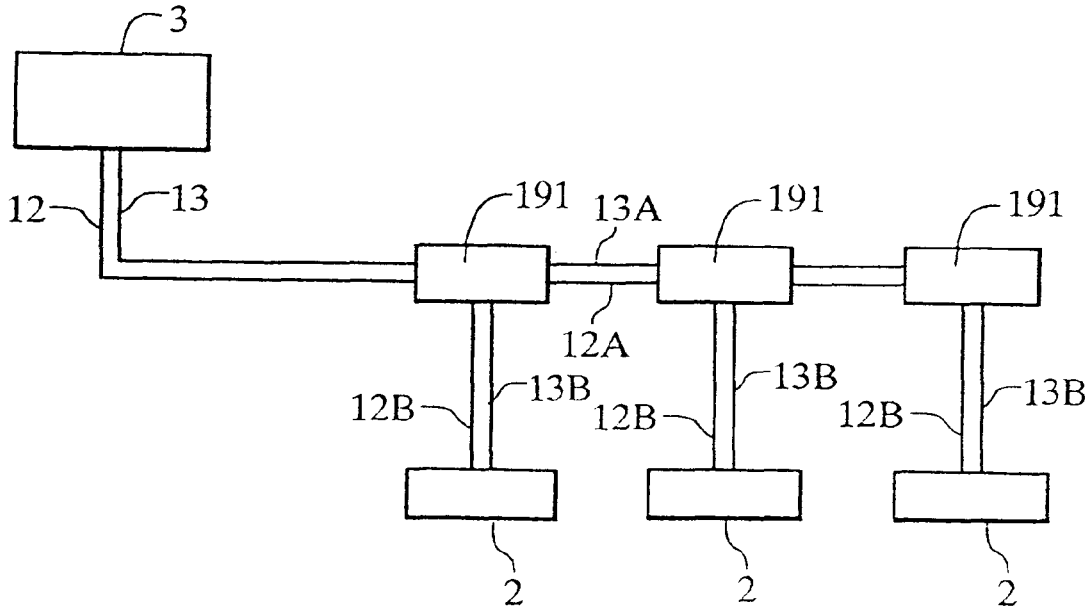
FIG. 29 is a view of another multiple type air conditioner.

Multiple type air conditioners are shown in FIG. 28 and FIG. 29. In an air conditioner in FIG. 28, a distributor 190 is provided at the ends of the main pipes 12A, 13A of the connecting pipes 12, 13 extended from an exterior instrument 3. Branch pipes 12B, 13B of each connecting pipes 12, 13 are extended from the distributor 190 to a plurality of interior instruments. In an air conditioner in FIG. 29, a plurality of distributors 191 are aligned on the main pipes 12A, 13A of connecting pipes 12, 13 extended from an exterior instrument 3, and the branch pipes 12B, 13B of the connecting pipes 12, 13 are extended from each distributor 191 to each unit of the interior instruments 2.

As has been described above, the present invention to provide two on-off valves in the first refrigerant piping or to provide on-off valves on each connecting pipe can be applied for a multiple type air conditioner in which a plurality of interior instruments 2 are joined with one unit of exterior instrument 3 through connecting pipes 12, 13, and such changes are also included in the scope of the present invention.

What is claimed is:

1. A method of reusing refrigerant in a heat exchanger being transferred from a first location to a second location, said heat exchanger including an interior instrument and an exterior instrument, a first refrigerant piping arranged in said interior instrument and having an interior heat exchanger, a second refrigerant piping arranged in said exterior instrument and having an exterior heat exchanger, connecting pipes connected with said first refrigerant piping and said second refrigerant piping to form refrigerant circulating channel to circulate a refrigerant, two on-off valves separately provided on upper and lower reaches of said second refrigerant piping in which the refrigerant flows through said exterior heat exchanger, and two on-off valves separately provided on upper and lower reaches of said first refrigerant piping in which the refrigerant flows through the interior heat exchanger, said method comprising the steps of:

closing said four on-off valves before physical transfer of the heat exchanger from the first to the second location;

removing said connecting pipes from both said first refrigerant piping and said second refrigerant piping;

connecting said connecting pipes or the like to said first refrigerant piping and said second refrigerant piping after transfer of the heat exchanger to said second location; and supplying any shortage of refrigerant to said refrigerant circulating channel, and opening said closed four on-off valves.

2. The reuse method according to claim 1, wherein at least two on-off valves provided for said first refrigerant piping or said second refrigerant piping are three-port valves having a connecting port to be connected with a refrigerant supply instrument to supply said any shortage of refrigerant into said refrigerant circulating channel.

3. A heat exchanger including:

an interior instrument and an exterior instrument, a first refrigerant piping arranged in said interior instrument and having an interior heat exchanger, a second refrigerant piping arranged in said exterior instrument and having an exterior heat exchanger, connecting pipes connected with said first refrigerant piping and said second refrigerant piping to form refrigerant circulating channel to circulate a refrigerant, two on-off valves separately provided on upper and lower reaches of said second refrigerant piping in which the refrigerant flows through said exterior heat exchanger, and two on-off valves separately provided on upper and lower reaches of said first refrigerant piping in which the refrigerant flows through the interior heat exchanger, wherein said two on-off valves connected with said refrigerant piping are first on-off valves disposed at end portions of said second refrigerant piping;

wherein said connecting pipes are provided with second on-off valves which are detachable from said first on-off valves;

wherein said two on-off valves connected with said first refrigerant piping are third on-off valves disposed at end portions of said first refrigerant piping; and wherein said connecting pipes are provided with fourth on-off valves which are detachable from said third on-off valves.

4. A method of reusing refrigerant in a heat exchanger transferred from a first location to a second location, said heat exchanger including an interior instrument and an exterior instrument, a first refrigerant piping arranged in said interior instrument and having an interior heat exchanger, a second refrigerant piping arranged in said exterior instrument and having an exterior heat exchanger, connecting pipes connected with said first refrigerant piping and said second refrigerant piping to form refrigerant circulating channel to circulate a refrigerant, two on-off valves separately provided on upper and lower reaches of said second refrigerant piping in which the refrigerant flows through said exterior heat exchanger, and two on-off valves separately provided on upper and lower reaches of said first refrigerant piping in which the refrigerant flows through the interior heat exchanger wherein said two on-off valves connected with said refrigerant piping are first on-off valves disposed at end portions of said second refrigerant piping;

wherein said connecting pipes are provided with second on-off valves which are detachable from said first on-off valves;

wherein said two on-off valves connected with said first refrigerant piping are third on-off valves disposed at end portions of said first refrigerant piping; and wherein said connecting pipes are provided with fourth on-off valves which are detachable from said third on-off valves, said method comprising the steps of:

closing all of said on-off valves before physical transfer of said heat exchanger from the first to the second location;

removing said connecting pipes from both said first refrigerant piping and said second refrigerant piping through detachment of said first on-off valves from said second on-off valves and said third on-off valves from said fourth on-off valves;

connecting said connecting pipes or the like to said first refrigerant piping and said second refrigerant piping through attachment of said first on-off valves with said second on-off valves and said third on-off valves with said fourth on-off valves, after the physical transfer of said heat exchanger; and opening all of said on-off valves.

5. A recovery method of refrigerant from a heat exchanger when the heat exchanger is disposed of, said heat exchanger including:

an interior instrument and an exterior instrument, a first refrigerant piping arranged in said interior instrument and having an interior heat exchanger, a second refrigerant piping arranged in said exterior instrument and having an exterior heat exchanger, connecting pipes connected with said first refrigerant piping and said second refrigerant piping to form refrigerant circulating channel to circulate a refrigerant, two on-off valves separately provided on upper and lower reaches of said second refrigerant piping in which the refrigerant flows through said exterior heat exchanger, and two on-off valves separately provided on upper and lower reaches of said first refrigerant piping in which the refrigerant flows through the interior heat exchanger, wherein said two on-off valves connected with said refrigerant piping are first on-off valves disposed at end portions of said second refrigerant piping;

wherein said connecting pipes are provided with second on-off valves which are detachable from said first on-off valves;

wherein said two on-off valves connected with said first refrigerant piping are third on-off valves disposed at end portions of said first refrigerant piping; and wherein said connecting pipes are provided with fourth on-off valves which are detachable from said third on-off valves, said recovery method comprising the steps of:

closing all of said on-off valves before the disposal of said heat exchanger;

removing said connecting pipes from said first refrigerant piping and said second refrigerant piping through detachment of said first on-off valves from said second on-off valves and said third on-off valves from said fourth on-off valves;

recovering the refrigerant from said first and second refrigerant pipings and said connecting pipes at a refrigerant recovery site; and disposing of said heat exchanger.

6. A heat exchanger including:

an interior instrument and an exterior instrument, a first refrigerant piping arranged in said interior instrument and having an interior heat exchanger, a second refrigerant piping arranged in said exterior instrument and having an exterior heat exchanger, connecting pipes connected with said first refrigerant piping and said second refrigerant piping to form refrigerant circulating channel to circulate a refrigerant, two on-off valves separately provided on upper and lower reaches of said second refrigerant piping in which the refrigerant flows through said exterior heat exchanger, and two on-off valves separately provided on upper and lower reaches of said first refrigerant piping in which the refrigerant flows through the interior heat exchanger, wherein said two on-off valves connected with said second refrigerant piping are disposed at end portions of said second refrigerant piping connected with said two connecting pipes;

wherein said two on-off valves connected with said first refrigerant piping are disposed at end portions of said first refrigerant piping connected with said two connecting pipes; and wherein at least two on-off valves of said first refrigerant piping or said second refrigerant piping have connecting ports connectable with a refrigerant recovery instrument and a refrigerant supply instrument and a continuous channel between the connecting port and said connecting pipe is still open, even when the continuous channel is closed between said connecting pipe and said refrigerant piping with which the on-off valve having the connecting port being provided.

7. A method of reusing refrigerant in a heat exchanger being transferred from an original place to a new place, said heat exchanger including:

an interior instrument and an exterior instrument, a first refrigerant piping arranged in said interior instrument and having an interior heat exchanger, a second refrigerant piping arranged in said exterior instrument and having an exterior heat exchanger, connecting pipes connected with said first refrigerant piping and said second refrigerant piping to form refrigerant circulating channel to circulate a refrigerant, two on-off valves separately provided on upper and lower reaches of said second refrigerant piping in which the refrigerant flows through said exterior heat exchanger, and two on-off valves separately provided on upper and lower reaches of said first refrigerant piping in which the refrigerant flows through the interior heat exchanger, wherein said two on-off valves connected with said second refrigerant piping are disposed at end portions of said second refrigerant piping connected with said two connecting pipes;

wherein said two on-off valves connected with said first refrigerant piping are disposed at end portions of said first refrigerant piping connected with said two connecting pipes; and wherein at least two on-off valves of said first refrigerant piping or said second refrigerant piping have connecting ports connectable with a refrigerant recovery instrument and a refrigerant supply instrument and a continuous channel between the connecting port and said connecting pipe is still open, even when the continuous channel is closed between said connecting pipe and said refrigerant piping with which the on-off valve having the connecting port being provided, said method comprising the steps of:

closing said four on-off valves before the transfer of said heat exchanger;

recovering the refrigerant from said connecting pipes by connecting the refrigerant recovery instrument to said connecting ports;

removing said connecting pipes from said first refrigerant piping and said second refrigerant piping;

connecting said removed connecting pipes or the like with said first refrigerant piping and said second refrigerant piping after the transfer of the heat exchanger; and supplying the refrigerant into said connecting pipes by connecting the refrigerant supply instrument to said connecting ports and opening said four on-off valves.

8. A recovery method of refrigerant from a heat exchanger when the heat exchanger is disposed of, said heat exchanger including:

an interior instrument and an exterior instrument, a first refrigerant piping arranged in said interior instrument and having an interior heat exchanger, a second refrigerant piping arranged in said exterior instrument and having an exterior heat exchanger, connecting pipes connected with said first refrigerant piping and said second refrigerant piping to form refrigerant circulating channel to circulate a refrigerant, two on-off valves separately provided on upper and lower reaches of said second refrigerant piping in which the refrigerant flows through said exterior heat exchanger, and two on-off valves separately provided on upper and lower reaches of said first refrigerant piping in which the refrigerant flows through the interior heat exchanger, wherein said two on-off valves connected with said second refrigerant piping are disposed at end portions of said second refrigerant piping connected with said two connecting pipes;

wherein said two on-off valves connected with said first refrigerant piping are disposed at end portions of said first refrigerant piping connected with said two connecting pipes; and wherein at least two on-off valves of said first refrigerant piping or said second refrigerant piping have connecting ports connectable with a refrigerant recovery instrument and a refrigerant supply instrument and a continuous channel between the connecting port and said connecting pipe is still open, even when the continuous channel is closed between said connecting pipe and said refrigerant piping with which the on-off valve having the connecting port being provided, said recovery method comprising the steps of:

closing said four on-off valves before the disposal of said heat exchanger;

recovering the refrigerant from said connecting pipes by connecting the refrigerant recovery instrument to said connecting ports;

removing said connecting pipes from said first refrigerant piping and said second refrigerant piping;

carrying said heat exchanger to a refrigerant recovery site and recovering the refrigerant from said first refrigerant piping and said second refrigerant piping; and disposing of said heat exchanger.

* * * * *